US010239315B2

(12) United States Patent
Toya et al.

(10) Patent No.: US 10,239,315 B2
(45) Date of Patent: Mar. 26, 2019

(54) LIQUID EJECTING APPARATUS

(71) Applicant: SEIKO EPSON CORPORATION, Tokyo (JP)

(72) Inventors: Akihiro Toya, Matsumoto (JP); Yoshiaki Shimizu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/607,197

(22) Filed: May 26, 2017

(65) Prior Publication Data

US 2017/0341395 A1 Nov. 30, 2017

(30) Foreign Application Priority Data

May 27, 2016 (JP) ..... 2016-106433

(51) Int. Cl.

| | |
|---|---|
| ***B41J 2/175*** | (2006.01) |
| ***B41J 2/14*** | (2006.01) |
| ***B41J 29/02*** | (2006.01) |
| *B41J 1/42* | (2006.01) |
| *B41J 29/13* | (2006.01) |

(52) U.S. Cl.

CPC ..... *B41J 2/14427* (2013.01); *B41J 2/1755* (2013.01); *B41J 2/17513* (2013.01); *B41J 2/17556* (2013.01); *B41J 29/02* (2013.01); *B41J 1/42* (2013.01); *B41J 2/14* (2013.01); *B41J 2/17503* (2013.01); *B41J 2/17553* (2013.01); *B41J 29/13* (2013.01); *B41J 2002/14346* (2013.01); *B41J 2002/17516* (2013.01)

(58) Field of Classification Search

CPC ... B41J 2/14427; B41J 2/17513; B41J 2/1755
See application file for complete search history.

(56) References Cited

U.S. PATENT DOCUMENTS

| | | | | |
|---|---|---|---|---|
| 2002/0051021 | A1 | 5/2002 | Mochizuki et al. | |
| 2005/0243148 | A1* | 11/2005 | Miyazawa | B41J 2/17509 347/86 |
| 2009/0290001 | A1* | 11/2009 | Domae | B41J 2/17513 347/85 |
| 2011/0310188 | A1* | 12/2011 | Kanbe | B41J 2/17513 347/86 |
| 2015/0062262 | A1* | 3/2015 | Petersen | B41J 2/17509 347/86 |

FOREIGN PATENT DOCUMENTS

| | | |
|---|---|---|
| JP | 2002-192752 | 7/2002 |
| JP | 2009-279876 | 12/2009 |

* cited by examiner

*Primary Examiner* — Jason S Uhlenhake
(74) *Attorney, Agent, or Firm* — Workman Nydegger

(57) ABSTRACT

A liquid ejecting apparatus includes a liquid ejecting head that ejects a liquid supplied from a liquid supplier which has an engaging portion, a container that has an engaging-portion-receiving portion with which the engaging portion engages, and an attaching portion to which the container is detachably attached. The liquid supplier is detachably attached to the attaching portion with movement of the container in a state where the engaging portion has engaged with the engaging-portion-receiving portion. The engaging portion engages with the engaging-portion-receiving portion to be relatively movable in a direction which crosses a movement path of the container when the container is attached to the attaching portion.

15 Claims, 29 Drawing Sheets

LIQUID EJECTING APPARATUS

BACKGROUND

1. Technical Field

The present invention relates to a liquid ejecting apparatus, such as a printer.

2. Related Art

An example of a liquid ejecting apparatus is an ink jet printer in which an ink bag containing ink and fixed to a tray is attached to the printer with movement of the tray (for example, JP-A-2009-279876).

A system in which an ink bag is fixed to a tray has the following issue. If the tray is displaced upon attachment to a printer, the ink bag is also displaced together with the tray, and the ink bag is not properly connected to the printer.

This issue is not limited to a printer in which an ink bag is fixed to a tray. Liquid ejecting apparatuses in which a liquid supplier is attached thereto with movement of a container generally have similar issues.

SUMMARY

An advantage of some aspects of the invention is to provide a liquid ejecting apparatus in which it is possible to properly attach a liquid supplier to the liquid ejecting apparatus with movement of a container.

Hereinafter, a device for solving the above issue and the effect thereof will be described. A liquid ejecting apparatus according to an aspect of the invention includes a liquid ejecting head that ejects a liquid supplied from a liquid supplier which has an engaging portion, a container that has an engaging-portion-receiving portion with which the engaging portion engages, and an attaching portion to which the container is detachably attached. The liquid supplier is detachably attached to the attaching portion with movement of the container in a state where the engaging portion has engaged with the engaging-portion-receiving portion. The engaging portion engages with the engaging-portion-receiving portion to be relatively movable in a direction which crosses a movement path of the container when the container is attached to the attaching portion.

According to this configuration, since the engaging portion of the liquid supplier engages with the engaging-portion-receiving portion to be relatively movable in the direction which crosses the movement path when the container is attached to the attaching portion, even if the position of the container is moved during attachment to the attaching portion, the liquid supplier moves relative to the container, and the position of the liquid supplier can be adjusted. Therefore, the liquid supplier may be properly attached with the movement of the container.

According to an aspect of the invention, the attaching portion includes a latching portion disposed in the movement path, and movement of the liquid supplier in a direction in which the liquid supplier is to be removed from the attaching portion is limited by the latching portion latching the container.

According to this configuration, since the latching portion provided in the attaching portion latches the container, movement of the liquid supplier in a direction that separates the liquid supplier from the attaching portion can be prevented without fixing the liquid supplier to the attaching portion.

According to an aspect of the invention, movement of the liquid supplier toward the starting end of the movement path is limited by the engaging portion engaging with the engaging-portion-receiving portion. According to this configuration, since the engaging portion of the liquid supplier engages with the engaging-portion-receiving portion of the container, even if the liquid supplier receives a reaction force during attachment, movement of the liquid supplier toward the starting end of the movement path within the container can be prevented.

According to an aspect of the invention, the container includes a pair of guide portions arranged in the direction which crosses the movement path in an attachment orientation for attachment to the attaching portion, and when the engaging portion engages with the engaging-portion-receiving portion, the guide portion guides the movement of the engaging portion.

According to this configuration, Since the engaging portion is moved along a pair of guide portions arranged in the direction which crosses the movement path when the container is attached to the attaching portion, the liquid supplier can be made to engage with the container at a proper position.

According to an aspect of the invention, the engaging-portion-receiving portion on a first side of the container has a shape that differs from the shape of the engaging-portion-receiving portion on a second side of the container in a direction which crosses the movement path. According to this configuration, in the container, since the shape of the engaging-portion-receiving portion with which the engaging portion engages differs between the first side and the second side in the direction which crosses the movement path when the container is attached to the attaching portion, the engaging portion does not engage in an improper direction. Therefore, the liquid supplier can be inserted into the container in an appropriate direction.

According to an aspect of the invention, the attaching portion includes an urging portion that urges the attached container toward a starting end of the movement path, and the container includes an urging receiving portion that receives an urging force of the urging portion at a leading end of the container upon attachment to the attaching portion.

According to this configuration, since the urging portion provided in the attaching portion urges the attached container toward the starting end of the movement path, the container can be easily removed from the attaching portion. According to an aspect of the invention, the liquid supplier includes a supply port used as an outlet port for the liquid, the attaching portion includes a positioning projection projecting in the movement path and a connecting portion with which the supply port is connected when the liquid supplier is attached, and the positioning projection engages with the liquid supplier which moves toward the connecting portion with movement of the container and limits movement of the liquid supplier in a direction which crosses the movement path.

According to this configuration, when the positioning projection engages with the liquid supplier moving toward the connecting portion, the movement of the liquid supplier in the direction which crosses the movement path when the container is attached to the attaching portion is limited. Therefore, after positioning of the liquid supplier by the positioning projection, the liquid supplier can be properly connected to the connecting portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a liquid ejecting apparatus according to the invention will be described with reference to the drawings. The liquid ejecting apparatus is, for example, an ink jet printer which records (i.e., prints) by ejecting ink, which is an example of a liquid, onto a medium, such as a paper sheet.

Figure 1:
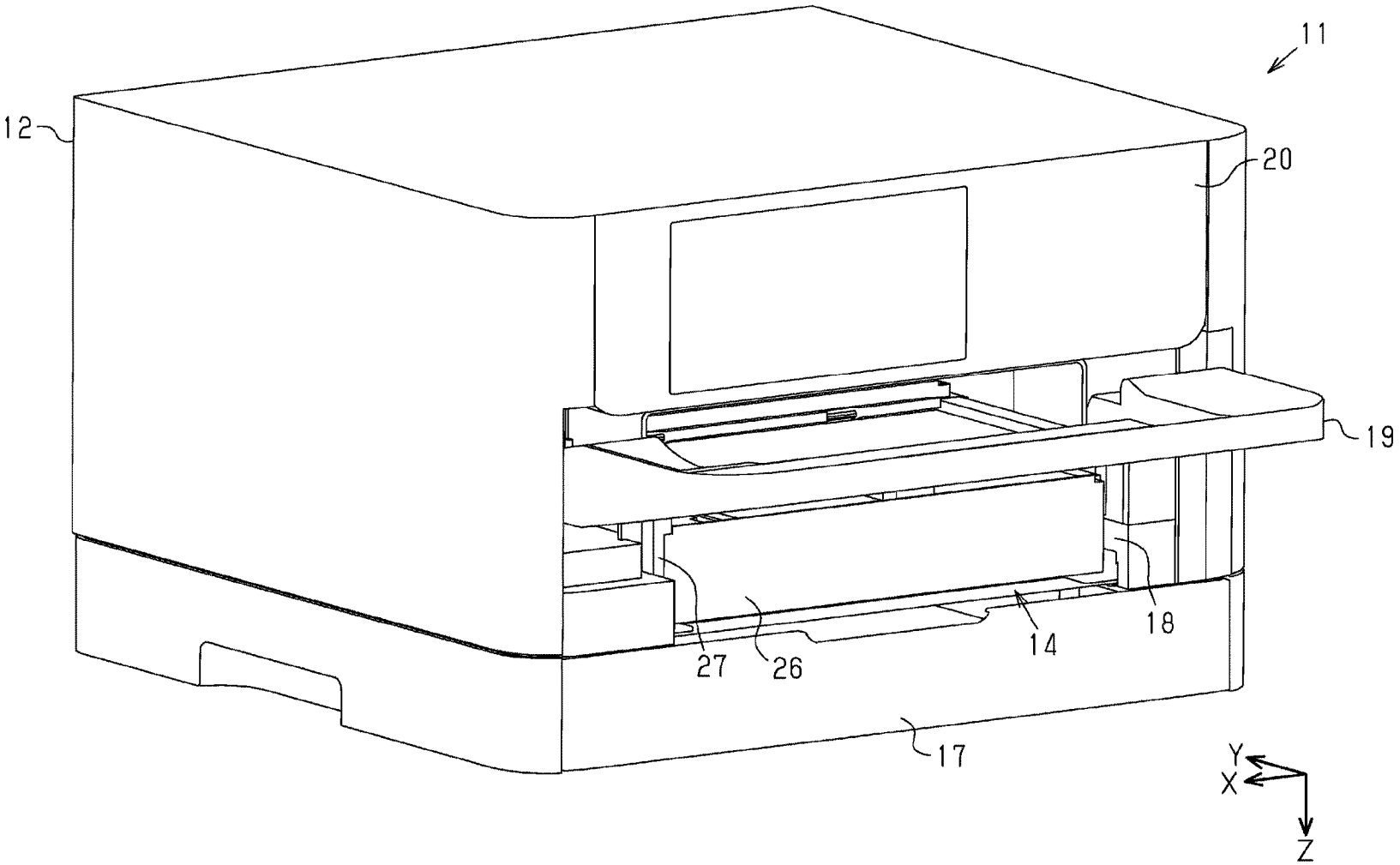
FIG. 1 is a perspective view of a liquid ejecting apparatus according to an embodiment.

As illustrated in FIG. 1, a liquid ejecting apparatus 11 includes an exterior body 12 having predetermined height, depth, and width dimensions in a state installed in a place of use. A front lid 17, an attachment opening 18, a discharge tray 19, and an operation panel 20 are disposed in this order from a bottom side to an upper side on a front surface of the exterior body 12. The front surface of the exterior body 12 is a surface having a height and a width and on which a user performs operations with respect to the liquid ejecting apparatus 11.

Figure 2:
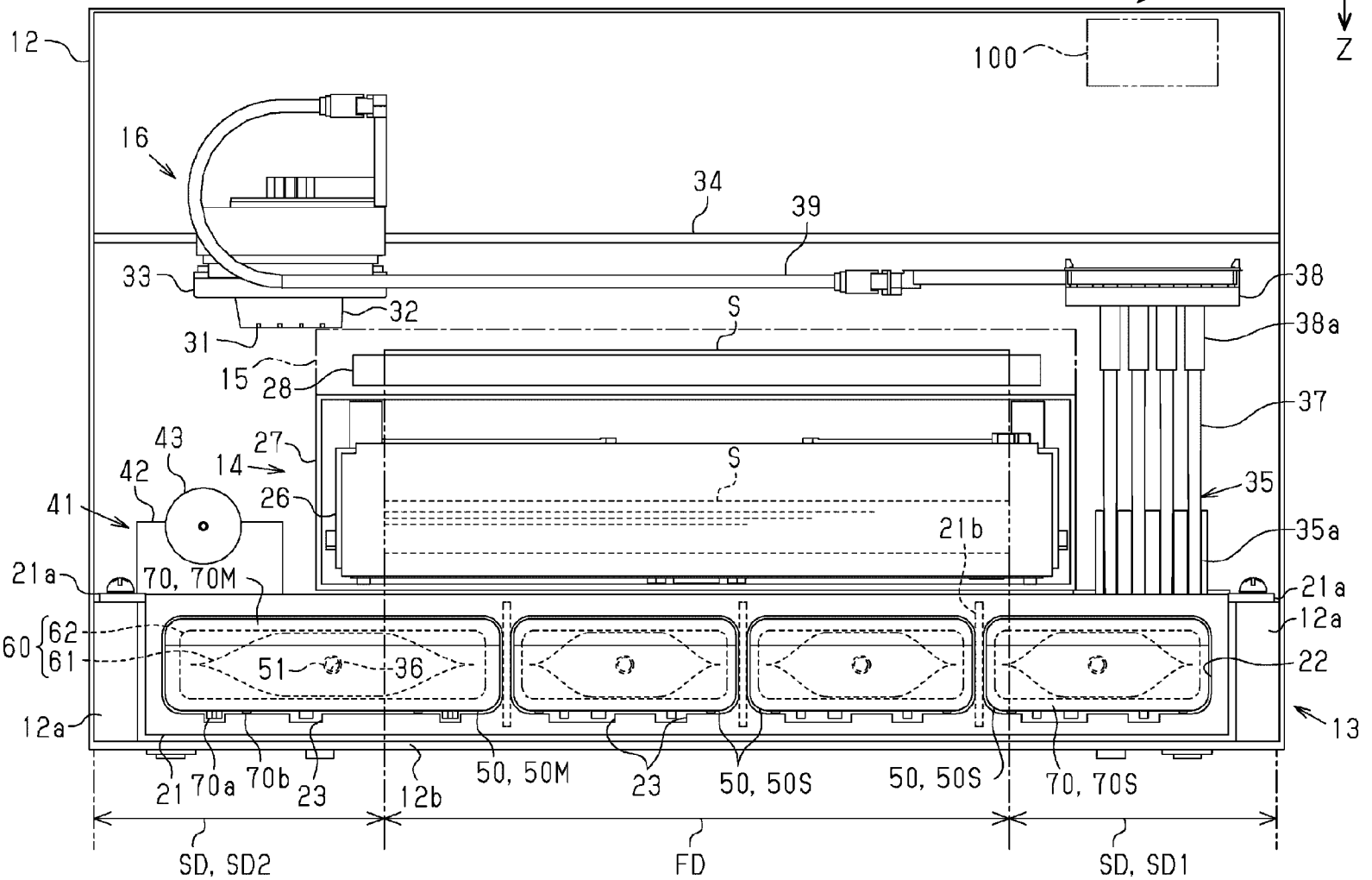
FIG. 2 is a front view of an internal structure of the liquid ejecting apparatus of FIG. 1.

As illustrated in FIGS. 1 and 2, an attaching portion 13, a medium container 14, a transport unit 15, and a recording unit 16 are accommodated inside the exterior body 12 at positions corresponding to the front lid 17, the attachment opening 18, the discharge tray 19, and the operation panel 20, in the depth direction. The liquid ejecting apparatus 11 includes, at an arbitrary position, a control device 100 which controls operations of the recording unit 16 and other parts.

As illustrated in FIG. 2, the attaching portion 13 includes a frame 21 which forms an accommodation space capable of accommodating one or a plurality of (four in the present embodiment) attachments 50, and connecting portions 36 disposed in the depth direction of the accommodation space. The frame 21 forms insertion ports 22 which communicate with the accommodation space from a front side. The attachments 50 enter the accommodation space through the insertion ports 22 and move along movement paths extending in the depth direction. Then, the attachments 50 are attached to the attaching portion 13.

In the present embodiment, a direction which, preferably perpendicularly, crosses the movement paths of the attachments 50 during attachment to the attaching portion 13 is a width direction, and a direction in which the movement paths extend is a depth direction. The width direction and the depth direction extend substantially along a horizontal plane. In the drawings, a direction of gravity corresponds to the Z-axis when the exterior body 12 is placed on a horizontal plane, and a moving direction when the attachments 50 are attached to the attaching portion 13 corresponds to the Y-axis. The moving direction may also be denoted as an attaching direction of the attaching portion 13 or as an inserting direction in the accommodation space. The direction opposite to the moving direction may also be denoted as a removing direction. The width direction corresponds to the X-axis, which perpendicularly crosses the Z-axis and the Y-axis. The width direction, the gravity direction, and the attaching direction cross one another, preferably in a perpendicular manner. These directions are used to denote width, height, and depth, respectively.

The exterior body 12 desirably includes support portions 12*a* which support the frame 21, which constitutes the attaching portion 13, at both ends in the width direction. The support portions 12*a* are desirably provided to project inward along a bottom plate portion 12*b* from both ends of the exterior body 12 in the width direction. Support projections 21*a* projecting from an outer edge and disposed on the support portions 12*a* are desirably provided at both ends of the frame 21 in the width direction.

It is more desirable to form a gap between a bottom portion of the frame 21 and the bottom plate portion 12*b* of the exterior body 12 by causing the support portions 12*a* of the exterior body 12 to support the frame 21 via the support projections 21*a*. Then, even if a part of the bottom plate portion 12*b* deforms as a result of being lifted when a small object, such as a pen, is caught under the bottom plate portion 12*b*, the frame 21 is not easily affected by the deformation. The support projections 21*a* may be fixed to the support portions 12*a* with screws, such that the frame 21 is fixed to the exterior body 12.

The accommodation space formed by the frame 21 is longer in the width direction than in the vertical direction and has a flat, laterally elongated shape when seen in the direction of the insertion ports 22. If a plurality of attachments 50 are to be attached to the attaching portion 13, the accommodation space may be divided into compartments corresponding to the number of the attachments 50 or may be a single space capable of accommodating a plurality of attachments 50. In the case where the accommodation space is divided, each compartment is also desirably longer in the width direction than in the vertical direction.

The attachment 50 of the present embodiment includes a liquid supplier 60 which has a supply port 51 as a liquid outlet port and a liquid container 61 containing a liquid, and a container 70 containing the liquid supplier 60. The liquid supplier 60 is held by the container 70 and forms the attachment 50. In this state, the liquid supplier 60 is detachably attached to the attaching portion 13 with movement of the container 70 in the depth direction. The container 70 is a component provided in the liquid ejecting apparatus 11 and is detachably attached to the attaching portion 13, even if no liquid supplier 60 is held thereon.

It is desirable that the width of each of the container 70 and the liquid supplier 60 is greater than the height of the container 70 and the liquid supplier 60 direction among the dimensions of height, depth, and width in an orientation attached to the attaching portion 13. The container 70 may desirably have a drawer shape capable of containing the liquid supplier 60. The container 70 does not necessarily have to contain the entire liquid supplier 60, but it is desirable that the container 70 hold and move the liquid supplier 60. For example, the container 70 may be a tray on which the liquid supplier 60 can be placed.

The liquid container 61 of the present embodiment consists of a flexible bag, and the supply port 51 communicates with the inside of the liquid container 61. In the present embodiment, the liquid containers 61 of the four liquid suppliers 60 contain different liquids (for example, different colors of ink, such as black, cyan, magenta, and yellow). The liquid supplier 60 is inserted into the accommodation space from the insertion port 22 while being held by the container 70. In the liquid supplier 60 held by the container 70, the supply port 51 is connected to the connecting portion 36 at an end of the movement path in the attaching direction of the container 70.

The connecting portions 36 are provided for each of the liquids in the recording unit 16. When the supply port 51 of the liquid supplier 60 is connected to the connecting portion 36, the liquid contained in the liquid container 61 can be supplied to the liquid ejecting apparatus 11 through the connecting portion 36.

A plurality of containers 70 having different widths may be attached to the attaching portion 13 of the present embodiment in the width direction and, together with the containers 70, a plurality of liquid suppliers 60 may be attached in the width direction. For example, as a plurality of containers 70, three or more containers 70 including a first container 70S and a second container 70M, which is wider than the first container 70S, are attached to the attaching portion 13. The second container 70M which is wider is attached closer to an end in the width direction than the first container 70S. If the containers 70 of different widths are to be attached to the attaching portion 13, each of the insertion ports 22 is desirably formed to have a width corresponding to the width of each container 70. The connecting portions 36 are arranged in the width direction at distances corresponding to the widths of the containers 70 to be attached.

The frame 21 desirably has a plurality of sets of linear guide rails 23 extending in the depth direction for guiding the movement of the containers 70 during attachment and removal. The guide rails 23 consist of one or a plurality of projections or recesses. Rail engaging portions 70*a* conforming to the projections or recesses of the guide rails 23 are desirably formed in the bottom portions of the containers 70 corresponding to the guide rails 23. With the existence of the guide rails 23, the movement paths of the containers 70 during attachment to the attaching portion 13 may become clear, and if a plurality of attachments 50 or containers 70 are to be inserted into a single accommodation space, the containers 70 may be moved without touching adjacent attachments 50 or the containers 70.

The width of the guide rails 23 or the number of the guide rails 23 may be determined to correspond to the width of each of the containers 70 to be attached. In this case, since the containers 70 of the same width may have rail engaging portions 70*a* of the same shape, the same member can be used in common. Alternatively, each of a plurality of sets of guide rails 23 may have a different width or number of rails to prevent improper attachment of the containers 70.

Three or more (four in the present embodiment) legs 70*b* for keeping the orientation of the container 70 horizontal may desirably be provided to project from the bottom portion of the container 70. Therefore, since the container 70 may be oriented vertically, the liquid supplier 60 and the connecting portion 36 may be properly connected with each other. Since the correct orientation of the container 70 can be maintained, the connection between the liquid supplier 60 and the connecting portion 36 may be maintained.

The medium container 14 includes a drawer-shaped medium receiver 26 which accommodates a medium S, and a guide frame 27 which guides movement of the medium receiver 26. The attaching portion 13 of the present embodiment is wider than the medium container 14.

The transport unit 15 includes a medium support portion 28 which supports the medium S. The transport unit 15 takes the medium S accommodated in the medium container 14 one at a time from the medium container 14, transports the medium S forward, and places the medium S on the medium support portion 28. The medium S is removed from the medium container 14 backward in an upper diagonal direction and is inverted by being brought forward while a trailing end is curved upward, and then transported onto the medium support portion 28. Therefore, a transportation path of the medium S is disposed in at least an area extending from the medium container 14 to an upper space of the medium support portion 28 in the vertical direction, in at least an area including widest part of the medium S, and in an area extending from a space behind the medium container 14 to the discharge tray 19 in the depth direction.

The medium receiver 26 and the medium support portion 28 are desirably arranged parallel to the frame 21 in the vertical direction. For example, in the present embodiment, the medium receiver 26 is disposed above the frame 21 in the vertical direction, and the medium support portion 28 is disposed above the medium receiver 26 in the vertical direction.

It is desirable that the width of the transportation path of the medium S be less than that of the frame 21 and that a transport area FD in which the transportation path of the medium S is disposed at a position adjacent to the frame 21 in the vertical direction and side areas SD located outside of the transportation path be arranged in the horizontal direction (desirably in the width direction). Two side areas SD, one on either side of the transport area FD, are desirably provided in the width direction. If the two side areas SD (SD1 and SD2) are disposed on the sides of the transport area FD in the width direction as described above, it is desirable that the medium container 14 be disposed near the center of the exterior body 12 in the width direction.

The side areas SD of the present embodiment are described as being separate from the transport area FD in the width direction. Regarding the vertical direction, the side areas SD may desirably be disposed adjacent to the frame 21 as the range of the side areas SD in the vertical direction has not been particularly defined.

Partition walls 21*b* for dividing the accommodation space in the width direction may be provided in the attaching portion 13 in the vertical direction below the medium container 14. In a case where the guide rails 23 are provided in the attaching portion 13, the partition walls 21*b* may desirably be provided at least at portions up to the position where the containers 70 engage with the guide rails 23 in the depth direction (see also FIGS. 3 and 9). By limiting the areas in which the partition walls 21*b* are provided to the vicinity of the insertion ports 22, the attaching portion 13 can be simplified in structure and reduced in weight. However, if the liquid ejecting apparatus 11 includes the medium container 14 which accommodates the media S, and the attaching portion 13 includes the frame 21 which forms the accommodation space capable of accommodating a plurality of containers 70, strength of the frame 21 supporting the medium container 14 and other parts can be increased by disposing the partition walls 21*b* at the rear side of the accommodation space.

The recording unit 16 includes a liquid ejecting head 32 which has nozzles 31 through which a liquid is ejected, and a carriage 33 which holds the liquid ejecting head 32. A guide shaft 34 extending in the width direction is installed inside the exterior body 12. The carriage 33 is made to reciprocate in the width direction along the guide shaft 34, and the liquid ejecting head 32 ejects the liquid onto the medium S on the medium support portion 28 while reciprocating, and in doing so, printing is performed.

In the present embodiment, in a moving area in the width direction of the liquid ejecting head 32, the right side of FIG. 2 is defined as the home side, and the left side of FIG. 2 is defined as the opposite-home side. The liquid ejecting head 32 remains in a standby state at an end of the home side when not being moved. The side area SD on the home side is defined as the side area SD1, and the side area SD on the opposite-home side is defined as the side area SD2.

The liquid ejecting apparatus 11 includes supply flow channels 35 which supply the liquid toward the liquid ejecting head 32 from the attaching portion 13, and a supply mechanism 41 configured to transport the liquid contained in the liquid container 61 of the liquid supplier 60 to the supply flow channel 35 through the supply port 51. The liquid ejecting head 32 ejects the liquid supplied through the supply flow channels 35 from the liquid supplier 60 onto the medium S.

Figure 3:
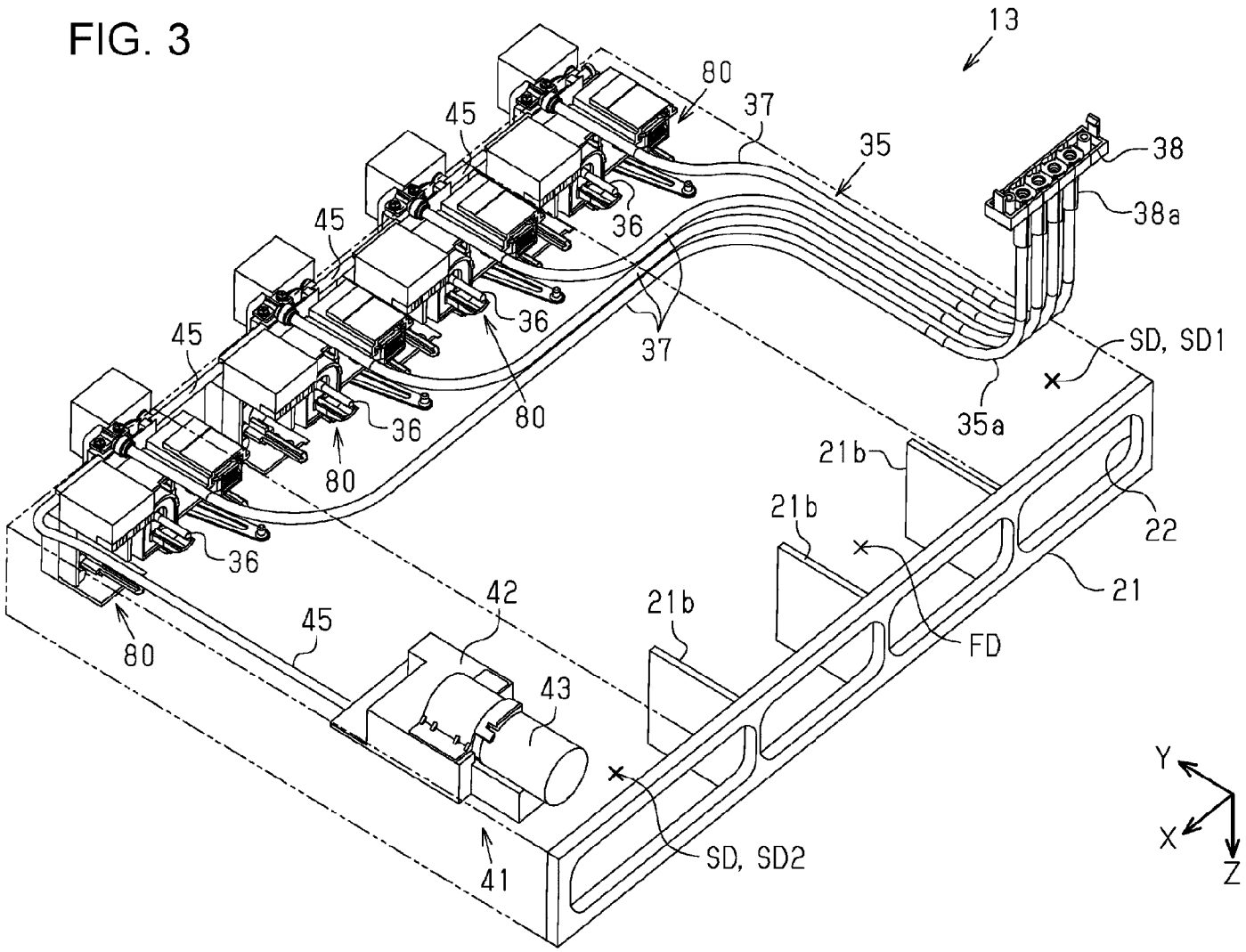
FIG. 3 is a perspective view of an attaching portion provided in the liquid ejecting apparatus of FIG. 1.

As illustrated in FIG. 3, the supply mechanism 41 includes a pressure regulating mechanism 42 and a driving source 43 of the pressure regulating mechanism 42 disposed in, for example, the side area SD2, pressure regulating chambers (not illustrated) disposed on the rear side of the connecting portions 36, and a pressure regulating flow channel 45 which connects the pressure regulating mechanism 42 and the pressure regulating chambers to each other. In FIG. 3, the front plate which forms the insertion ports 22 is indicated by a solid line about the frame 21.

The supply flow channels 35 are provided for each liquid (for each color in the present embodiment). The supply flow channel 35 includes the connecting portion 36 which forms an upstream end, a flexible supply tube 37, a joint portion 38 to which a downstream end of the supply tube 37 is detachably connected, and a displacement portion 39 (see FIG. 2) extending from the joint portion 38 to the carriage 33. The displacement portion 39 is, for example, a flexible tube in which a plurality of flow channels through which different liquids flow are disposed in parallel. The displacement portion 39 is desirably flexibly deformed following movement of the carriage 33 (see FIG. 2).

A pump chamber (not illustrated) is provided between the connecting portion 36 and the supply tube 37. A downstream end of the connecting portion 36 and an upstream end of the supply tube 37 communicate with the pump chamber. The pump chamber is divided via the pressure regulating chamber (not illustrated) described above and a flexible film (not illustrated).

When the pressure regulating mechanism 42 reduces pressure in the pressure regulating chamber through the pressure regulating flow channel 45 by being driven the driving source 43 (for example, a motor), the flexible film is bent and displaced toward the pressure regulating chamber, and the pressure in the pump chamber is decreased. With the decrease in the pressure in the pump chamber, the liquid contained in the liquid container 61 is sucked into the pump chamber through the connecting portion 36. This phenomenon is called suction driving. Then, when the pressure regulating mechanism 42 releases the pressure-reduction in the pressure regulating chamber through the pressure regulating flow channel 45, the flexible film is bent and displaced toward the pump chamber, and the pressure in the pump chamber is increased. Then, as a result of the increased pressure in the pump chamber, the liquid in the pump chamber flows into the supply tube 37 in a pressurized state. This phenomenon is called ejection driving. The supply mechanism 41 supplies the liquid to the supply flow channels 35 from the liquid suppliers 60 (see FIG. 2) by repeating the suction driving and the ejection driving alternately.

In the present embodiment, a plurality of pressure regulating chambers and a plurality of pump chambers corresponding to each type of liquid are provided, and the pressure regulating mechanism 42 and the driving source 43 cause pressure variation in a plurality of pressure regulating chambers via the pressure regulating flow channel 45. The pressure regulating mechanism 42 may cause ejection driving by sending pressurized gas into the pressure regulating chamber through the pressure regulating flow channel 45 by driving the driving source 43, such that the flexible film is bent and displaced toward the pump chamber.

The joint portion 38 includes a plurality of connecting pipes 38*a* which open vertically downward, for example. A plurality of supply tubes 37 may be detachably attached to the connecting pipes 38*a*. The joint portion 38 is desirably disposed on the front side in the depth direction of the side area SD1. In the side area SD1, the supply flow channel 35 desirably includes a direction-changing portion 35*a* in which a flow direction of the liquid is changed to the vertical direction from the horizontal direction. Alternatively, the joint portion 38 may include a connecting pipe 38*a* which opens horizontally and a connecting pipe 38*a* which opens vertically, which form the direction-changing portion 35*a*.

The supply tube 37 and the pressure regulating flow channel 45 include a portion disposed along an upper surface of the frame 21. In the present embodiment, for example, on the rear side of the insertion port 22, the four connecting portions 36 are arranged in the width direction, and the four supply tubes 37 connected to the connecting portions 36 extend horizontally along the upper surface of the frame 21 and are collected in the side area SD1. After directions of downstream portions of the four collected supply tubes 37 are changed to vertically upward directions, the downstream portions are connected to the joint portions 38 disposed in the side area SD1. A portion of the pressure regulating flow channel 45 along the upper surface of the frame 21 in the side area SD2 extends in the depth direction, a portion closer to an end is bent and extends in the width direction and communicates with the four pressure regulating chambers.

Next, a configuration of the attaching portion 13 will be described in detail. The attaching portion 13 includes connection mechanisms 80 that are disposed to correspond to each of the connecting portions 36 on the rear portion of the accommodation space.

Figure 4:
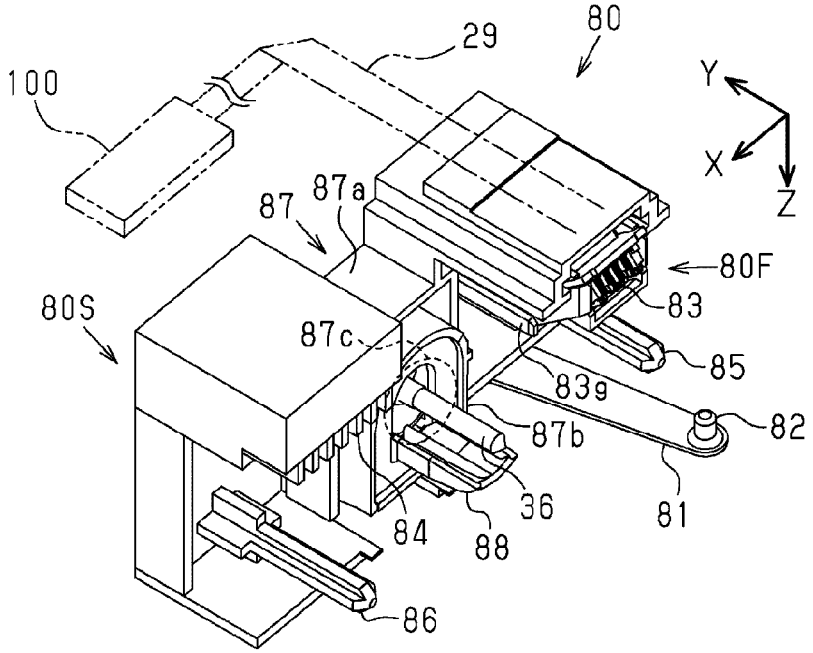
FIG. 4 is a perspective view of a connection mechanism provided in the attaching portion of FIG. 3.

As illustrated in FIG. 4, the connection mechanism 80 has a first connection mechanism 80F and a second connection mechanism 80S disposed on the sides of the connecting portion 36 in the width direction. The first connection mechanism 80F of the connection mechanism 80 located on the home side in the width direction includes an arm 81 projecting in the removing direction, which is in the vertical direction, below the connecting portion 36, and a latching portion 82 is provided at a distal end of the arm 81. A distal end of the arm 81 is pivotable about a base end. The latching portion 82 projects vertically upward, for example, from the arm 81 and is disposed in the movement path of the container 70 during attachment to the attaching portion 13 (see FIG. 3).

The first connection mechanism 80F includes a terminal portion 83 which is disposed in the vertical direction above the connecting portion 36 and projects in the removing direction. The terminal portion 83 is connected to the control device 100 via an electric line 29, such as a flat cable. It is desirable that an upper end of the terminal portion 83 projects in the removing direction further than a lower end and is disposed to be oriented diagonally downward. On the sides of the terminal portion 83 in the width direction, a pair of guide projections 83*g* is desirably provided to project in the width direction and extends in the attaching direction.

The second connection mechanism 80S of the connection mechanism 80 disposed on the opposite-home side in the width direction desirably includes a block 84 to prevent improper insertion. The block 84 projects in the removing direction, which is in the vertical direction, above the connecting portion 36. The block 84 has protrusions which form indentations, and the shape of the projections and the indentations differ for each connection mechanism 80.

The connection mechanism 80 includes a pair of positioning projections 85 and 86, a pressing mechanism 87 disposed to surround the connecting portion 36, and a liquid receiving portion 88 projecting in the removing direction below the connecting portion 36. A pair of positioning projections 85 and 86 is disposed on the sides of the connecting portion 36 in the width direction so as to be included in the first connection mechanism 80F and the second connection mechanism 80S, respectively. The positioning projections 85 and 86 may be bar-shaped projections projecting parallel to each other in the removing direction, for example. Projection lengths of the positioning projections 85 and 86 in the removing direction are desirably longer than the projection length of the connecting portion 36 in the removing direction.

The pressing mechanism 87 includes a frame member 87*a* surrounding a base end portion of the connecting portion 36, a pressing portion 87*b* projecting from the frame member 87*a* in the removing direction, and an urging portion 87*c* urging the container 70 in the removing direction toward a starting end of the movement path via the pressing portion 87*b*. The urging portion 87*c* can be a coil spring mounted between the frame member 87*a* and the pressing mechanism 87, for example.

Figure 5:
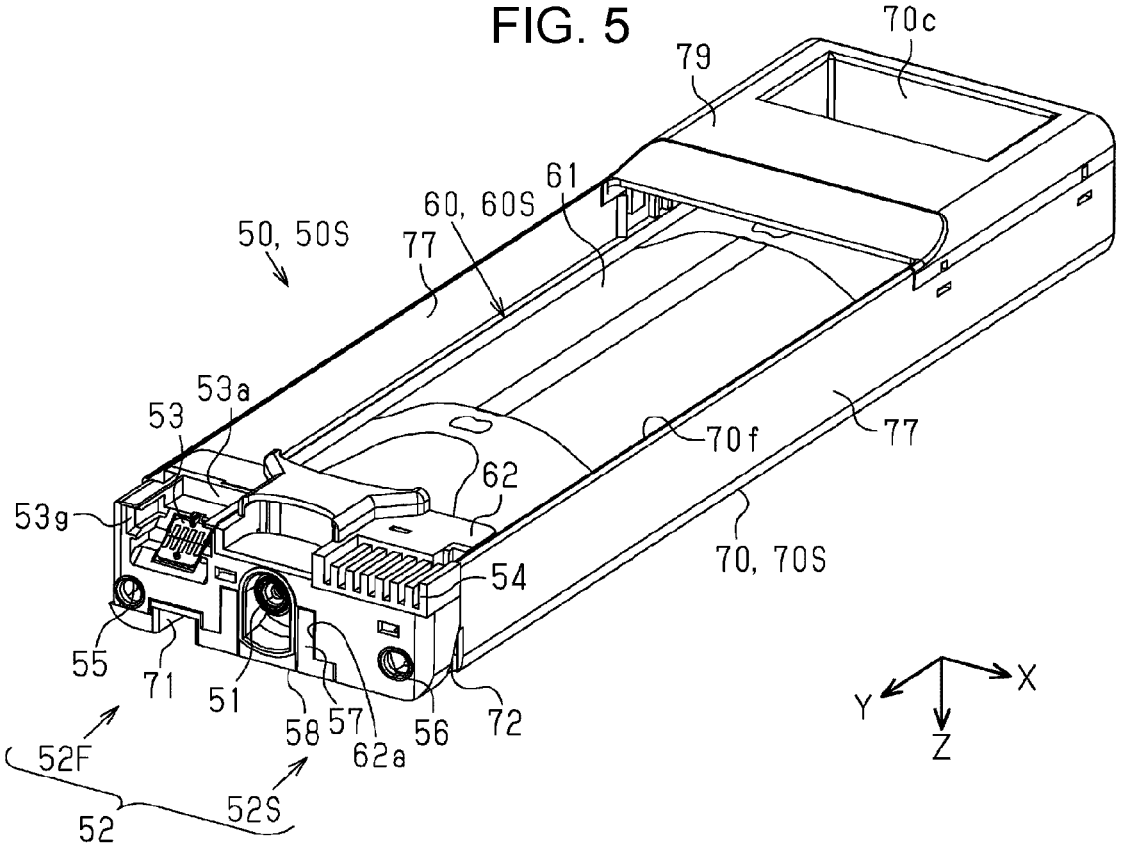
FIG. 5 is a perspective view of a first attachment attached to the attaching portion of FIG. 3.

As illustrated in FIG. 5, when a forward end upon attachment to the attaching portion 13 (see FIG. 3) is defined as a front end and an end opposite to the front end is defined as a base end, the attachment 50 includes a connection structure 52 at the front end. The connection structure 52 has a first connection structure 52F and a second connection structure 52S on both sides of the supply port 51 in the width direction.

The first connection structure 52F of the connection structure 52 disposed on the home side upon attachment includes a connection terminal 53 disposed in the vertical direction above the supply port 51. The connection terminal 53 is provided, for example, on a surface of a circuit board, and the circuit board includes a storage unit which stores various types of information about the liquid supplier 60 (for example, the type of the liquid supplier 60, and liquid capacity).

The connection terminal 53 is desirably disposed to be oriented diagonally upward in a recess 53*a* which opens upward and in the attaching direction. Guide recesses 53*g* extending in the attaching direction are desirably disposed on both sides of the connection terminal 53 in the width direction.

The second connection structure 52S of the connection structure 52 disposed on the opposite-home side during attachment desirably includes an identification member 54 for the prevention of improper insertion disposed in the vertical direction above the supply port 51. The identification member 54 has projections and recesses of shape to fit the block 84 (see FIG. 4) of the connection mechanism 80 to be connected.

The connection structure 52 includes a pair of positioning holes 55 and 56, an urging receiving portion 57 which receives the urging force of the urging portion 87*c* (see FIG. 4), and an inserting portion 58 extending below the supply port 51. The positioning holes 55 and 56 are disposed on both sides of the supply port 51 in the width direction so as to be included in the first connection structure 52F and the second connection structure 52S, respectively. The first positioning hole 55 included in the first connection structure 52F is desirably a circular hole, whereas the second positioning hole 56 included in the second connection structure 52S is desirably an elliptical hole elongated in the width direction.

The liquid supplier 60 includes an engaging portion 62 provided integrally with the supply port 51. The container 70 includes, at the end portion thereof, an engaging-portion-receiving portion 72 with which the engaging portion 62 of the liquid supplier 60 can engage. The engaging portion 62 of the liquid supplier 60 includes the recess 53*a*, the connection terminal 53, the guide recesses 53*g*, the identification member 54, and the positioning holes 55 and 56. The engaging-portion-receiving portion 72 of the container 70 includes the urging receiving portion 57. The engaging portion 62 is located at the front end portion of the container 70 when the engaging portion 62 engages with the engaging-portion-receiving portion 72. The urging receiving portion 57 provided in the engaging-portion-receiving portion 72 has a function as an engagement projection which engages with a front end surface of the engaging portion 62.

Figure 12:
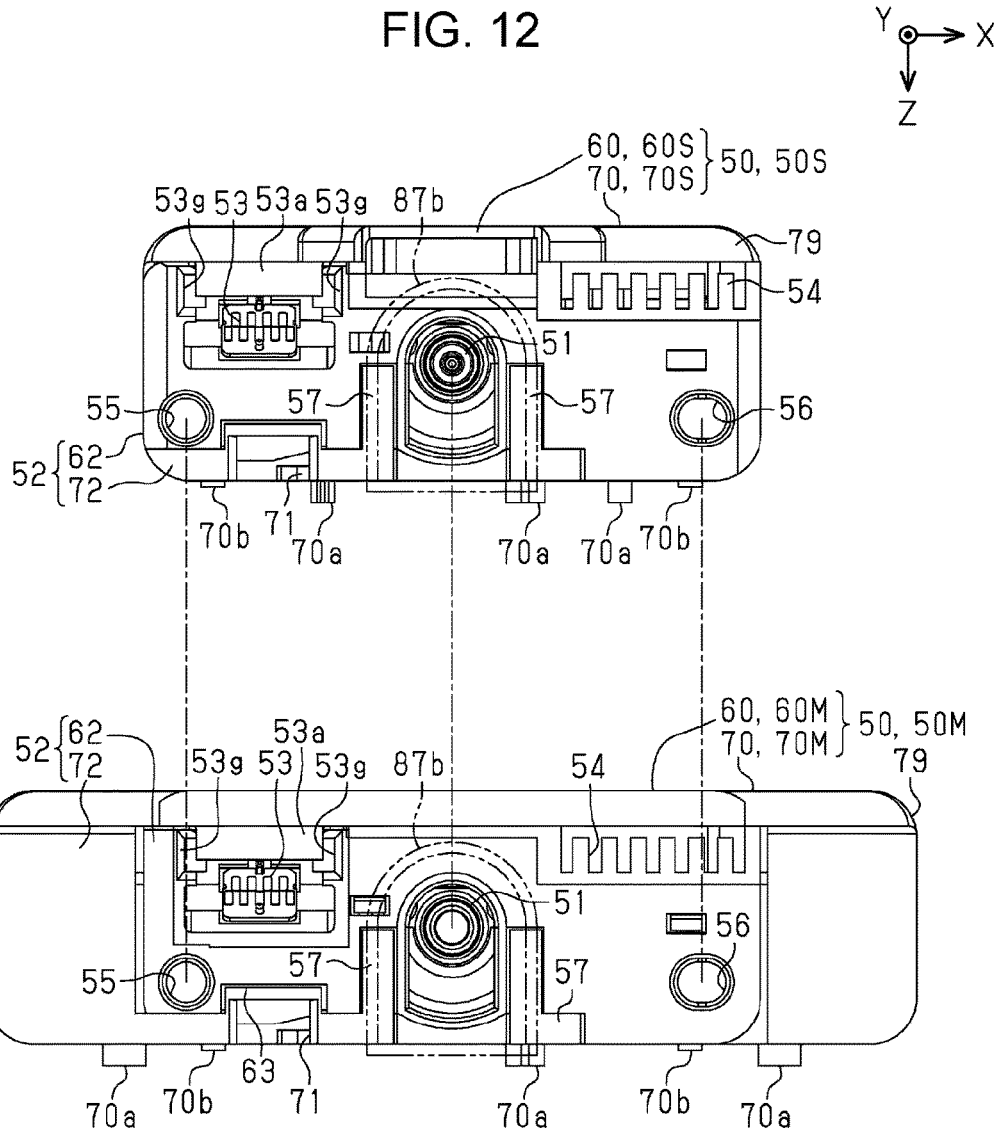
FIG. 12 is a front view of the first attachment of FIG. 5 and of a second attachment having a width different from that of the first attachment.

The urging receiving portion 57 abuts against the pressing portion 87*b* when the connection structure 52 is connected to the connection mechanism 80 (see FIG. 4), and receives the urging force of the urging portion 87*c* (see also FIG. 12). A pair of urging receiving portions 57 are desirably disposed on both sides of the supply port 51 so that the attachment 50 is not inclined with respect to the moving direction when the urging force of the urging portion 87*c* is applied.

The liquid supplier 60 desirably has an accommodation recess 62*a* on a front end surface of the engaging portion 62. When the urging receiving portion 57 of the container 70 is accommodated in the accommodation recess 62*a*, the urging receiving portion 57 desirably constitutes a front end surface of the attachment 50 together with the front end surface of the engaging portion 62. Then, when the attachment 50 is attached, the urging force of the urging portion 87*c* (see FIG. 4) is received by the urging receiving portion 57 of the container 70 so that the liquid supplier 60 is not pressed in the removing direction.

Next, with reference to FIGS. 4 and 5, a connection of the connection structure 52 provided in the attachment 50 with respect to the connection mechanism 80 will be described. When the attachment 50 is inserted into the accommodation space and the front end approaches the connection mechanism 80, the front ends of the positioning projections 85 and 86 with long projection lengths in the removing direction are inserted into the positioning holes 55 and 56 of the liquid supplier 60 to engage with each other, and the movement of the liquid supplier 60 in the width direction is limited. Since the second positioning hole 56 is an elliptical elongated hole extending in the width direction, the positioning projection 85 inserted into the circular first positioning hole 55 is a reference for the positioning.

The positioning holes 55 and 56 provided in the engaging portion 62 of the liquid supplier 60 may be other shape than holes (or through holes) and may be, for example, walls to engage with the positioning projections 85 and 86. However, the portions to engage with the positioning projections 85 and 86 in the engaging portion 62 are desirably holes (or through holes) because positioning in the vertical direction besides the width direction may be performed when the portions engage with the positioning projections 85 and 86.

After the positioning projections 85 and 86 engage with the positioning holes 55 and 56, and the attachment 50 is moved further toward the rear side, the supply port 51 of the liquid supplier 60 is connected to the connecting portion 36. Thus, the liquid supplier 60 is desirably positioned by the positioning projections 85 and 86 before the connecting portion 36 is connected to the supply port 51.

In the attachment 50, if the positioning holes 55 and 56 project further than the supply port 51 on the end, for example, even if the positioning projections 85 and 86 have the same projection lengths as or a projection length shorter than that of the connecting portion 36, the positioning projections 85 and 86 can engage with the liquid supplier 60 before the connecting portion 36 does. Therefore, the lengths of the positioning projections 85 and 86 may be changed. The positioning projections 85 and 86 may desirably project in the movement path when the container 70 is attached to the attaching portion 13. When the positioning projections 85 and 86 engage with side surfaces of the engaging portion 62 in the width direction, for example, the positioning projections 85 and 86 may project in the vertical direction.

When the attachment 50 is inserted at a correct position, the identification member 54 fits properly in the block 84 of the connection mechanism 80. If the attachment 50 is to be attached to an improper position, the identification member 54 does not fit in the block 84 and the attachment 50 does not move further toward the rear direction. Therefore, improper attachment is prevented.

When the attachment 50 is moved in the attaching direction, the terminal portion 83 enters the recess 53*a* of the attachment 50, and the guide recesses 53*g* are guided by the guide projections 83*g*. Therefore, the positions are adjusted and the terminal portion 83 touches the connection terminal 53. Then, the connection terminal 53 is electrically connected to the terminal portion 83 and information is transmitted and received between the circuit board and the control device 100. It is desirable to dispose the first positioning hole 55 as the positioning reference in the first connection structure 52F which includes the connection terminal 53 (as one of the first connection structure 52F and the second connection structure 52S).

If physical identification of the attachment 50 by the identification member 54 and the block 84 is not performed, it may be determined by software whether the attached attachment 50 is proper based on information received by the control device 100 from the circuit board. Alternatively, attachment of the attachment 50 may be detected when the control device 100 receives information from the circuit board.

When the supply port 51 of the liquid supplier 60 is connected to the connecting portion 36 so that the liquid can be supplied and the connection terminal 53 touches the terminal portion 83 and is electrically connected therewith, the connection of the connection structure 52 with respect to the connection mechanism 80 is completed.

Figure 6:
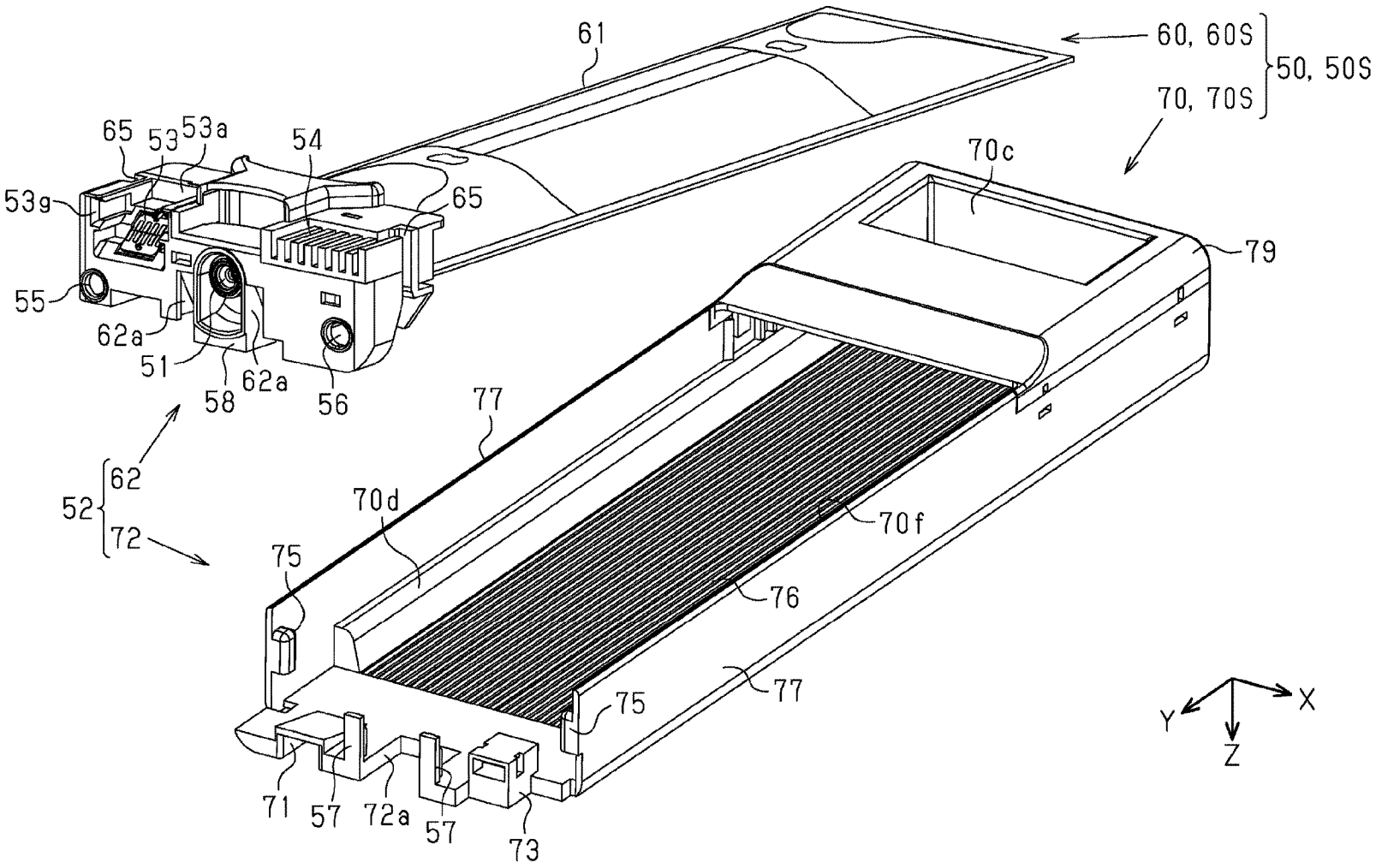
FIG. 6 is a perspective view of a first liquid supplier and a first container which constitute the first attachment of FIG. 5.

Next, an engaging structure between the liquid supplier 60 and the container 70 which constitute the attachment 50 will be described in detail. If an orientation of the attachment 50 upon attachment to the attaching portion 13 (see FIG. 3) is defined as an attachment orientation, as illustrated in FIG. 6, the engaging portion 62 engages with the engaging-portion-receiving portion 72 with a vertically downward relative movement with the engaging-portion-receiving portion 72 of the container 70. When the engaging portion 62 of the liquid supplier 60 engages with the engaging-portion-receiving portion 72 of the container 70, the liquid supplier 60 joins the container 70, thereby constituting the attachment 50. The engaging portion 62 and the engaging-portion-receiving portion 72 constitute the connection structure 52 of the attachment 50.

The container 70 is in the attachment orientation when being attached to the attaching portion 13, and the liquid supplier 60 is in the attachment orientation when the engaging portion 62 engages with the engaging-portion-receiving portion 72 of the container 70 which is in the attachment orientation.

Figure 7:
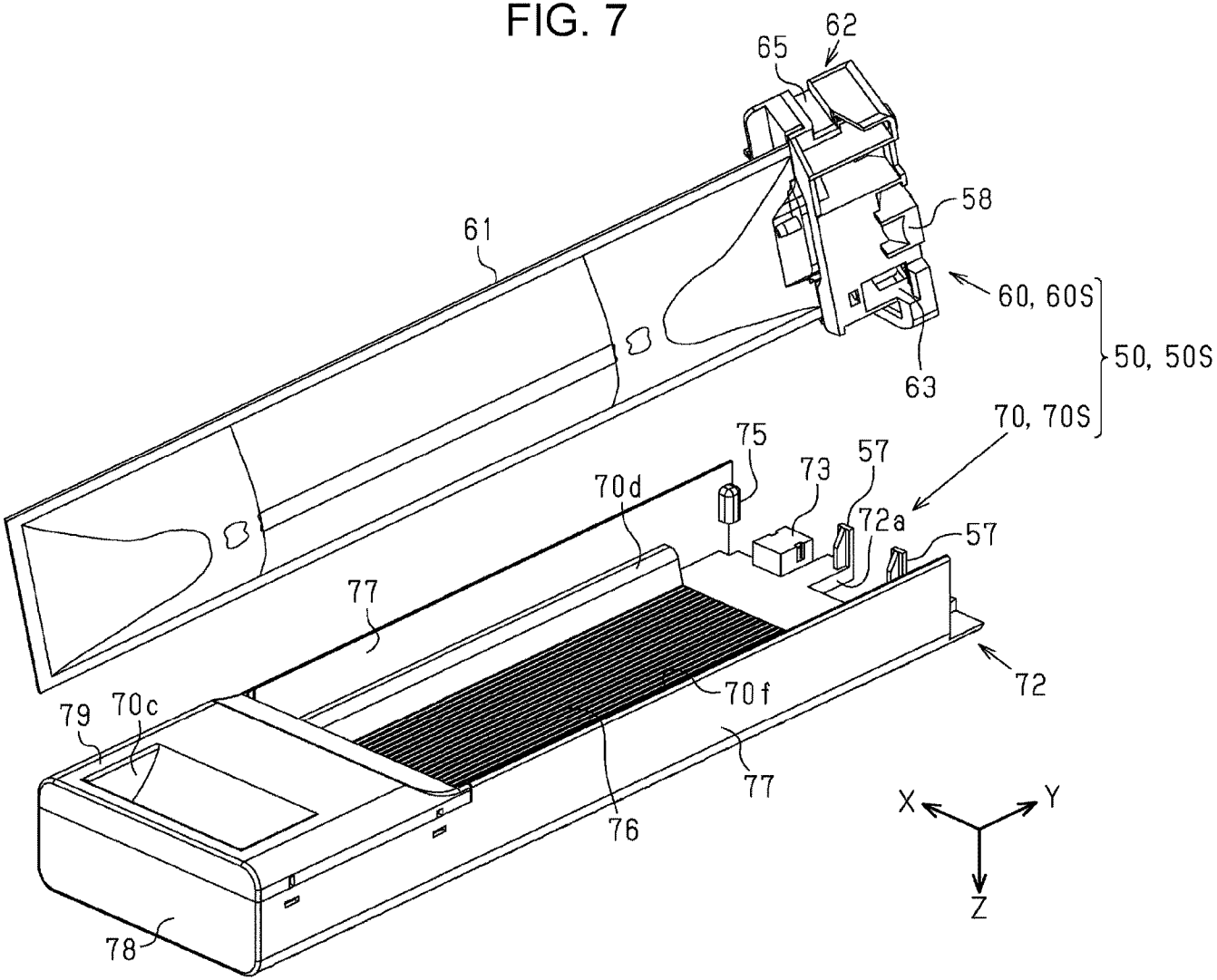
FIG. 7 is a perspective view of the first liquid supplier and the first container of FIG. 6 seen from another angle.

When the liquid supplier 60 is in the attachment orientation, the inserting portion 58 projects vertically downward from the supply port 51. As illustrated in FIG. 7, the liquid supplier 60 includes an identification recess 63 which opens vertically downward in the attachment orientation at a position adjacent to the inserting portion 58 in the width direction. The engaging portion 62 of the liquid supplier 60 includes a pair of engaging recesses 65 disposed at both ends of the engaging portion 62 in the width direction, and are provided as recesses opening in the width direction in the attachment orientation.

The engaging-portion-receiving portion 72 of the container 70 includes a notch 72*a* which engages with the inserting portion 58 at a center in the width direction in the attachment orientation. The engaging-portion-receiving portion 72 includes an identification projection 73 which projects vertically upward at a position corresponding to the identification recess 63. The engaging-portion-receiving portion 72 of the container 70 includes a pair of guide portions 75 which are aligned in the width direction, extend in a direction to cross the attaching direction (the vertical direction in the attachment orientation), and project inwardly of the container 70.

The identification recess 63 and the identification projection 73 are provided on one side (on the opposite-home side in the attachment state) in the width direction of the inserting portion 58 and the notch 72*a*, respectively. Therefore, the engaging portion 62 of the liquid supplier 60 and the engaging-portion-receiving portion 72 of the container 70 differ in shape on a first side and on a second side in the width direction. Accordingly, it is not possible to properly engage the engaging portion 62 of the liquid supplier 60 with the engaging-portion-receiving portion 72 if the engaging portion 62 is to be attached in a different direction (for example, upside down or reversed back to front) or at a different position (for example, the engaging portion 62 is disposed ahead or behind the engaging-portion-receiving portion 72 in the attaching direction).

If the engaging portion 62 engages with the engaging-portion-receiving portion 72 with a vertically downward relative movement with the engaging-portion-receiving portion 72, the engaging recesses 65 and the guide portions 75 may desirably be formed to extend in the direction of the relative movement. Then, when the engaging portion 62 engages with the engaging-portion-receiving portion 72, the guide portions 75 engage with the engaging recesses 65 and the guide portions 75 guide the movement of the liquid supplier 60. The identification projection 73 is accommodated in the identification recess 63 and the urging receiving portion 57 is accommodated in the accommodation recess 62*a*, whereby engagement between the liquid supplier 60 and the container 70 is completed.

Figure 8:
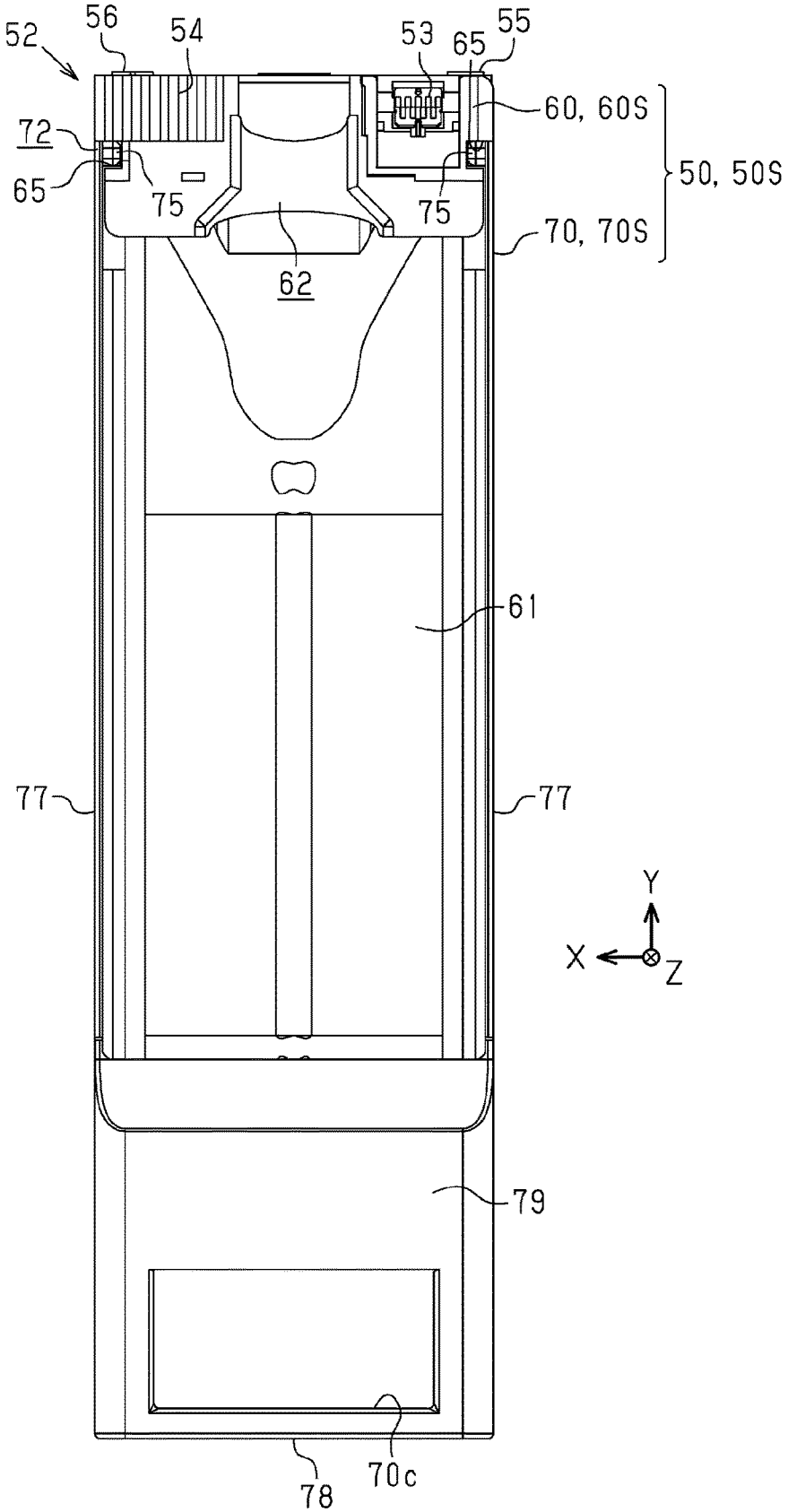
FIG. 8 is a top view of the first attachment of FIG. 5.

As illustrated in FIG. 8, in the present embodiment, the guide portions 75 of the container 70 are projections in shape and the engaging recesses 65 of the liquid supplier 60 engages with the projections. However, the guide portions 75 of the container 70 may be recesses by which the engaging portion 62 of the liquid supplier 60 may be guided.

The engaging recesses 65 of the engaging portion 62 are shaped so that a gap is formed between the engaging recesses 65 and the guide portions 75 when the engaging recesses 65 engage with the guide portions 75 of the engaging-portion-receiving portion 72. A distance over which the engaging portion 62 relatively movable in the width direction by the gap with respect to the engaging-portion-receiving portion 72 is desirably longer than a distance over which the engaging portion 62 relatively movable in the attaching direction.

That is, the gap in the attaching direction is desirably formed such that the guide portions 75 may be inserted into the engaging recesses 65 but are not substantially moved after the engagement, whereas the gap in the width direction is desirably formed such that the engaging portion 62 may be moved slightly with respect to the engaging-portion-receiving portion 72 in the width direction. A moving distance of the engaging portion 62 allowed in the width direction by the gap may be made equivalent to a difference in the length (a diameter) in the width direction of the first positioning hole 55 and the second positioning hole 56, for example.

Thus, by engaging the engaging portion 62 of the liquid supplier 60 with the engaging-portion-receiving portion 72 to be relatively movable in the directions which cross the attaching direction (the width direction and the vertical direction), the liquid supplier 60 in which the engaging portion 62 has engaged with the engaging-portion-receiving portion 72 may be movable relative to the container 70 in the width direction and the vertical direction. Since the engaging portion 62 engages with the engaging-portion-receiving portion 72, the movement of the liquid supplier 60 in the attaching direction (the movement in the direction toward the starting end of the movement path) is limited.

With the configuration described above, as illustrated in FIG. 9, when the attachment 50 enters the accommodation space divided by the partition walls 21*b* and is moved in the attaching direction with the rail engaging portion 70*a* engaging with the guide rail 23, the position of the liquid supplier 60 in the direction which crosses the attaching direction is adjusted roughly. Then, as the positioning projection 85 enters the first positioning hole 55, the liquid supplier 60 relatively moves with the container 70 in the direction which crosses the attaching direction, whereby the position of the liquid supplier 60 is adjusted precisely.

Since the positioning projections 85 and 86 engage with the positioning holes 55 and 56 when the liquid supplier 60 is moved toward the connecting portion 36 with the movement of the container 70 in a state where the engaging portion 62 engages with the engaging-portion-receiving portion 72, the position of the supply port 51 of each liquid supplier 60 is adjusted with respect to the position where the connecting portion 36 exists. Then, the liquid supplier 60 moves in the attaching direction with the movement in the direction which crosses the attaching direction is limited, and the supply port 51 is properly connected to the connecting portion 36. Similarly, the positioned connection terminal 53 is properly connected to the terminal portion 83.

Figure 9:
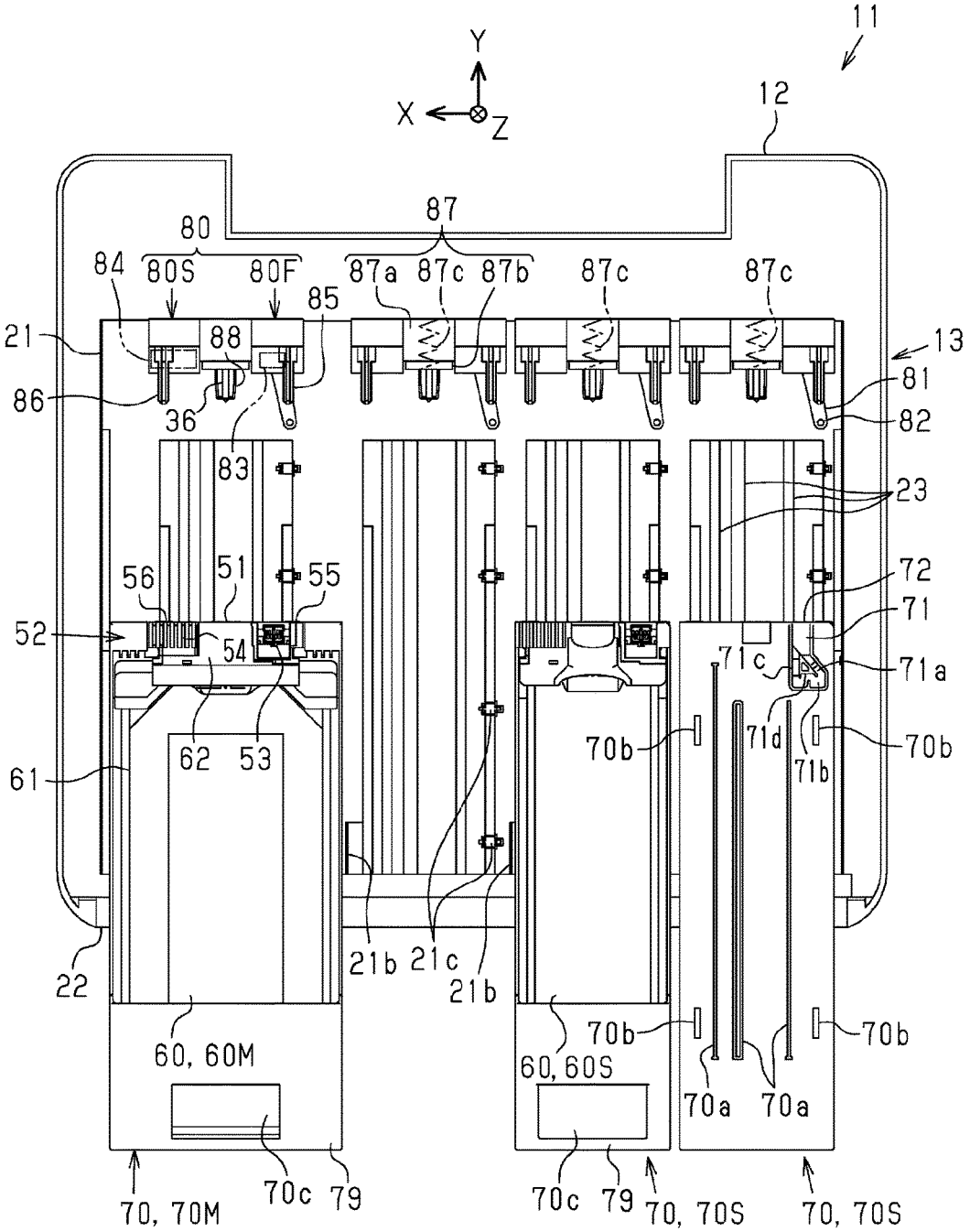
FIG. 9 is a plan view schematically illustrating how the attachment is attached to the attaching portion of FIG. 3.
Figure 10:
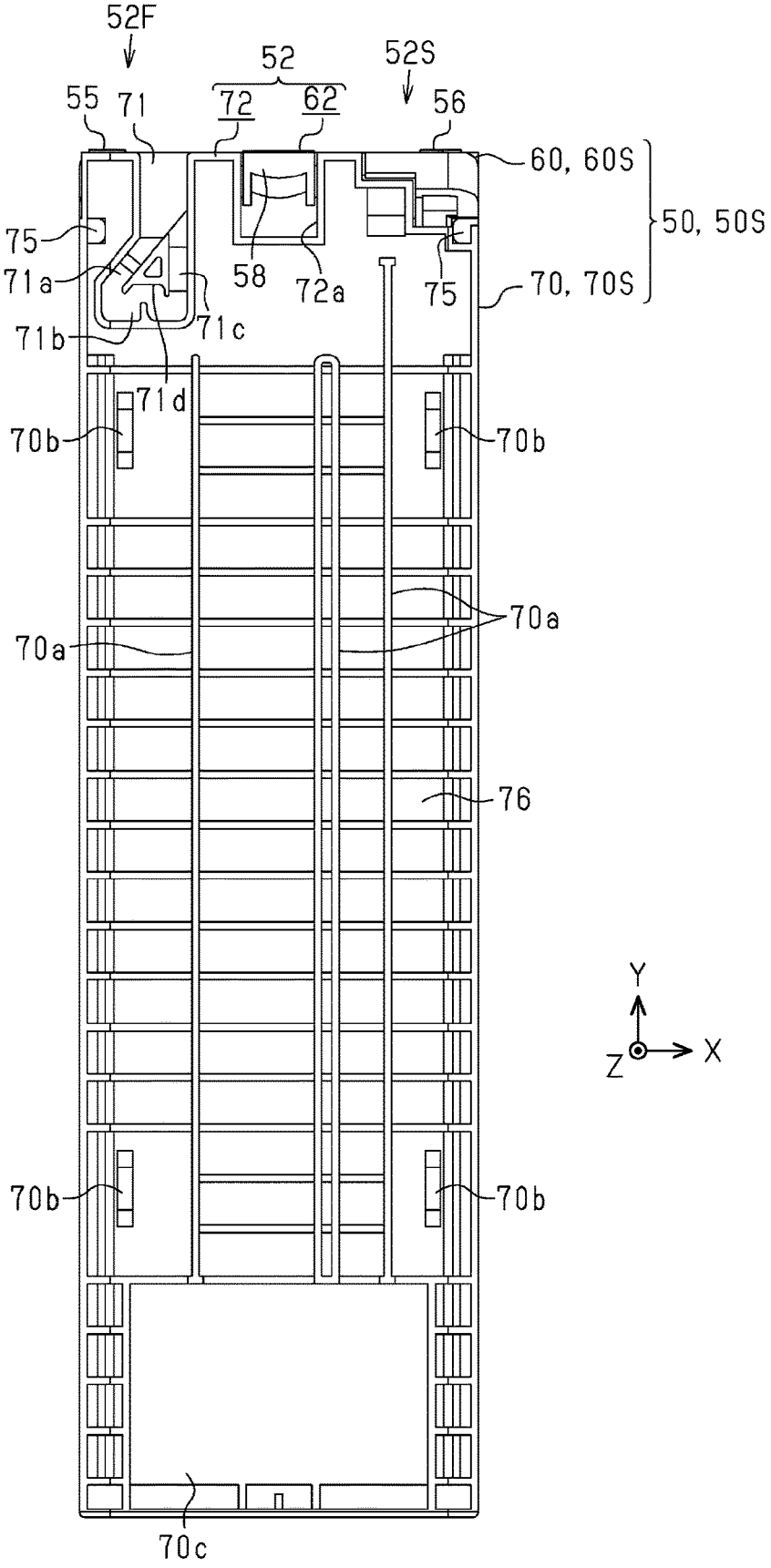
FIG. 10 is a bottom view of the first attachment of FIG. 5.

Next, an attachment and removal structure of the container 70 with respect to the attaching portion 13 will be described. As illustrated in FIGS. 9 and 10, an engaging groove 71 is formed as a recess extending in the removing direction from the front end on a bottom surface of the container 70. In FIG. 9, regarding the attachment 50 located closest to the home side (the right end in FIG. 9), main components of the bottom surface of the container 70 are illustrated in a top perspective view. The engaging groove 71 desirably constitutes the connection structure 52, and is included in the first connection structure 52F (as one of the first connection structure 52F and the second connection structure 52S) in which the first positioning hole 55 as the positioning reference is also included.

The engaging groove 71 may be a heart cam groove which includes, for example, a first inclined groove 71*a* extending in the removing direction from the front end of the bottom surface, a latch groove 71*b* extending in the width direction from a termination end of the first inclined groove 71*a*, and a second inclined groove 71*c* extending toward a starting end of the first inclined groove 71*a* from a termination end of the latch groove 71*b*.

As illustrated in FIG. 9, when the container 70 approaches a termination end of the movement path upon attachment to the attaching portion 13, the latching portion 82 provided to project at the distal end of the arm 81 engages with the engaging groove 71. The first inclined groove 71*a*, the latch groove 71*b*, and the second inclined groove 71*c* are inclined so that the grooves become shallower toward their termination ends from their starting ends, respectively, whereby a step is formed in each crossing portion. Therefore, after the latching portion 82 engages with the starting end of the first inclined groove 71*a*, and the container 70 is moved in the attaching direction, the latching portion 82 engages with the first inclined groove 71*a*, the latch groove 71*b*, and the second inclined groove 71*c* along the inclination in this order. Therefore, the latching portion 82 does not move back from the latch groove 71*b* to the first inclined groove 71*a*, or from the second inclined groove 71*c* to the latch groove 71*b*.

The latch groove 71*b* has a shape in which a portion between the starting end and the termination end is bent toward the front end. The latch groove 71*b* has an engagement wall portion 71*d* at the bent portion located on the rear side of the latching portion 82 in the attaching direction and engages with the latching portion 82. When the latching portion 82 engages with the engagement wall portion 71*d*, the movement of the container 70 in the removing direction is limited while receiving the urging force of the urging portion 87*c*, and the state where the container 70 is attached to the attaching portion 13 is maintained.

When the container 70 is latched by the latching portion 82, attachment of the container 70 to the attaching portion 13 is completed. Since the container 70 is latched by the latching portion 82, the movement of the liquid supplier 60 which has engaged with the container 70 in the removing direction from the attaching portion 13 is limited.

Since a target which the latching portion 82 latches is the container 70, the container 70 alone may be attached to the attaching portion 13 besides as the attachment 50 which accommodates the liquid supplier 60. In a case where the liquid supplier 60 is inserted into the accommodation space alone without engaging with the container 70, the liquid supplier 60 is not latched by the latching portion 82, and the pressing portion 87*b* touches the front end of the engaging portion 62 (see FIG. 12), and is pressed back by the urging force of the urging portion 87*c*. Therefore, the liquid supplier 60 is not able to be attached to the attaching portion 13 alone.

If the container 70 with the liquid supplier 60 placed thereon is inserted into the accommodation space in a state where the engaging portion 62 of the liquid supplier 60 does not engage properly with the engaging-portion-receiving portion 72 of the container 70 (for example, the engaging portion 62 is disposed ahead from the engaging-portion-receiving portion 72 in the attaching direction), the arm 81 does not reach the engaging groove 71 of the container 70. Therefore, the container 70 is not latched and the liquid supplier 60 is pressed back in the removing direction. In a case where the container 70 on which the liquid supplier 60 is placed is inserted into the accommodation space in a state where the engaging portion 62 is disposed behind from the engaging-portion-receiving portion 72 in the attaching direction, since the container 70 is latched but the supply port 51 does not reach the connecting portion 36, the liquid supplier 60 is not able to be connected to the connecting portion 36.

If the container 70 is attached to the attaching portion 13 alone without engaging with the liquid supplier 60, the connection terminal 53 is not connected to the terminal portion 83. Therefore, the control device 100 (see FIG. 2) may determine that the liquid supplier 60 is not connected to the connecting portion 36.

When the container 70 inserted into the accommodation space is pressed in the attaching direction by a user and relatively moves along the first inclined groove 71*a* while the latching portion 82 engages with the engaging groove 71, the container 70 receives the urging force of the urging portion 87*c*. Therefore, after the latching portion 82 is moved from the first inclined groove 71*a* to the latch groove 71*b* until the latching portion 82 engages with the engagement wall portion 71*d*, the container 70 is moved in the removing direction slightly by the urging force of the urging portion 87*c*.

At the termination end of the movement in the removing direction, a tactile "click" response (contact sound) may be caused when the latching portion 82 touches the engagement wall portion 71*d*, for example. Therefore, the user may be provided with tactile sense or impression that the attachment of the container 70 is completed. Therefore, occurrence of defective attachment resulting from improper insertion of the container 70, for example, can be prevented.

Also when engaging the container 70 with the liquid supplier 60, to provide the user with a tactile "click" response to inform the completion of the engagement, a magnet, a snap fit, and the like may be provided in a contact area between the identification recess 63 and the identification projection 73.

When the container 70 is pressed in the attaching direction by the user while the latching portion 82 engages with the engagement wall portion 71*d*, the latching portion 82 is moved to the second inclined groove 71*c* along the inclination of the latch groove 71*b*, and then is moved toward the termination end of the second inclined groove 71*c* by the urging force of the urging portion 87*c* along the inclination of the second inclined groove 71*c*, whereby engagement with the engaging groove 71 is released. Then, the container 70 is moved in the removing direction by the urging force of the urging portion 87*c* and a base end portion of the container 70 comes out of the frame 21 and the exterior body 12 through the insertion port 22.

If the liquid supplier 60 engages with the container 70 at this time, the supply port 51 is separated from the connecting portion 36 and the connection of the liquid supplier 60 is released as the container 70 is moved in the removing direction by the urging force of the urging portion 87*c* and, the connection terminal 53 is separated from the terminal portion 83 and attachment of the liquid supplier 60 to the attaching portion 13 is released. To help the user grip the container 70 when the base end portion of the container 70 comes out of the exterior body 12, a hand grip 70*c* to help grip may desirably be provided in the base end portion of the container 70.

Next, desirable configurations of the liquid supplier 60 and the container 70 will be described in detail. As illustrated in FIG. 7, the container 70 of the present embodiment includes a bottom plate 76 constituting a bottom surface, side plates 77 provided to stand vertically upright from both ends in the width direction of the bottom plate 76, and a front plate 78 provided to stand vertically upright from a base end of the bottom plate 76. Front end portions of the bottom plate 76 and the side plates 77 constitute the engaging-portion-receiving portion 72.

In the container 70, the bottom plate 76, the side plates 77, and the front plate 78 constitute a main body which forms the storing space which stores the liquid supplier 60. The container 70 has an opening 70*f* through which the liquid supplier 60 is placed in or removed from the storing space. In the present embodiment, the opening 70*f* of the container 70 opens in a different direction than a direction (the attaching direction) in which the container 70 moves upon attachment to the attaching portion 13 (a vertically upward direction in the attachment orientation).

In the present embodiment, the drawer-shaped container 70 has no front plates to be used as side walls on the front end, and the container 70 opens on the upper side and the front side as a box. When the engaging portion 62 of the liquid supplier 60 engages with the engaging-portion-receiving portion 72, the opening on the front end is blocked, and an outer shape of the attachment 50 becomes a substantially rectangular parallelepiped shape as illustrated in FIG. 5.

As illustrated in FIG. 7, if the liquid supplier 60 includes a flexible liquid container 61, it is desirable to limit an unnecessary movement of the liquid container 61 within the container 70 by providing, for example, a rib or an embossment on an upper surface of the bottom plate 76.

The liquid container 61 of the present embodiment is formed as a bag constituted by two rectangular laminated film materials with four sides joined. The supply port 51 and the engaging portion 62 are attached on the short side at the front end. As the amount of liquid contained in the bag is greater, a center portion of the bag swells, and the vicinity of outer edges of the bag becomes thinner. Therefore, a support projection 70*d* which supports the thin outer edge portion of the bag may be provided at an inner portion of the container 70 where the bottom plate 76 and the side plate 77 cross.

When a cover 79 for covering a part of the storing space is provided at a part of the base end side of the container 70, protrusion of the liquid container 61 from the storing space can be prevented even if the liquid container 61 is bent and deformed. The base end side of the bag may be bent upward when the liquid contained in the bag is reduced. Therefore, when the cover 79 is disposed to cover a part of the base end side of the storing space in the container 70, protrusion of the base end of the liquid container 61 can be prevented. The cover 79 of the present embodiment fits into the side plates 77 with claws 79*a* (see FIG. 36) constituted by small projecting pieces.

If the substantially rectangular parallelepiped-shaped container 70 opens also on the front end side besides the upper side, the liquid supplier 60 is easily attached and removed also in the container 70 having the cover 79. If the container 70 opens on the front end side besides the upper side, when the width of the engaging portion 62 of the liquid supplier 60 is set to be equal to or greater than the width of the container 70, the engaging portion 62 does not enter the inside of the pair of side plates 77 of the container 70.

If the hand grip 70*c* is provided in the container 70, a recess provided in the cover 79 may desirably be used as the hand grip 70*c*. An upper surface of the cover 79 may desirably be provided with a rib or an embossment to make the container 70 hardly slip when the user grips the hand grip 70*c*. As other forms, in the container 70, the hand grip 70*c* may be provided as a recess on the front plate 78, or a handle for holding may be provided to project on the front plate 78.

In addition, a part of or all (for example, the cover 79 or the front plate 78) of the container 70 may be formed by a transparent member, or a transparent window may be placed in the cover 79 or the front plate 78, whereby the inside of the container 70 may be viewed from the base end side. Therefore, if the liquid leaks within the container 70 in the attachment state, for example, the situation can be viewed from the outside and the leakage of the liquid can be discovered promptly.

Figure 11:
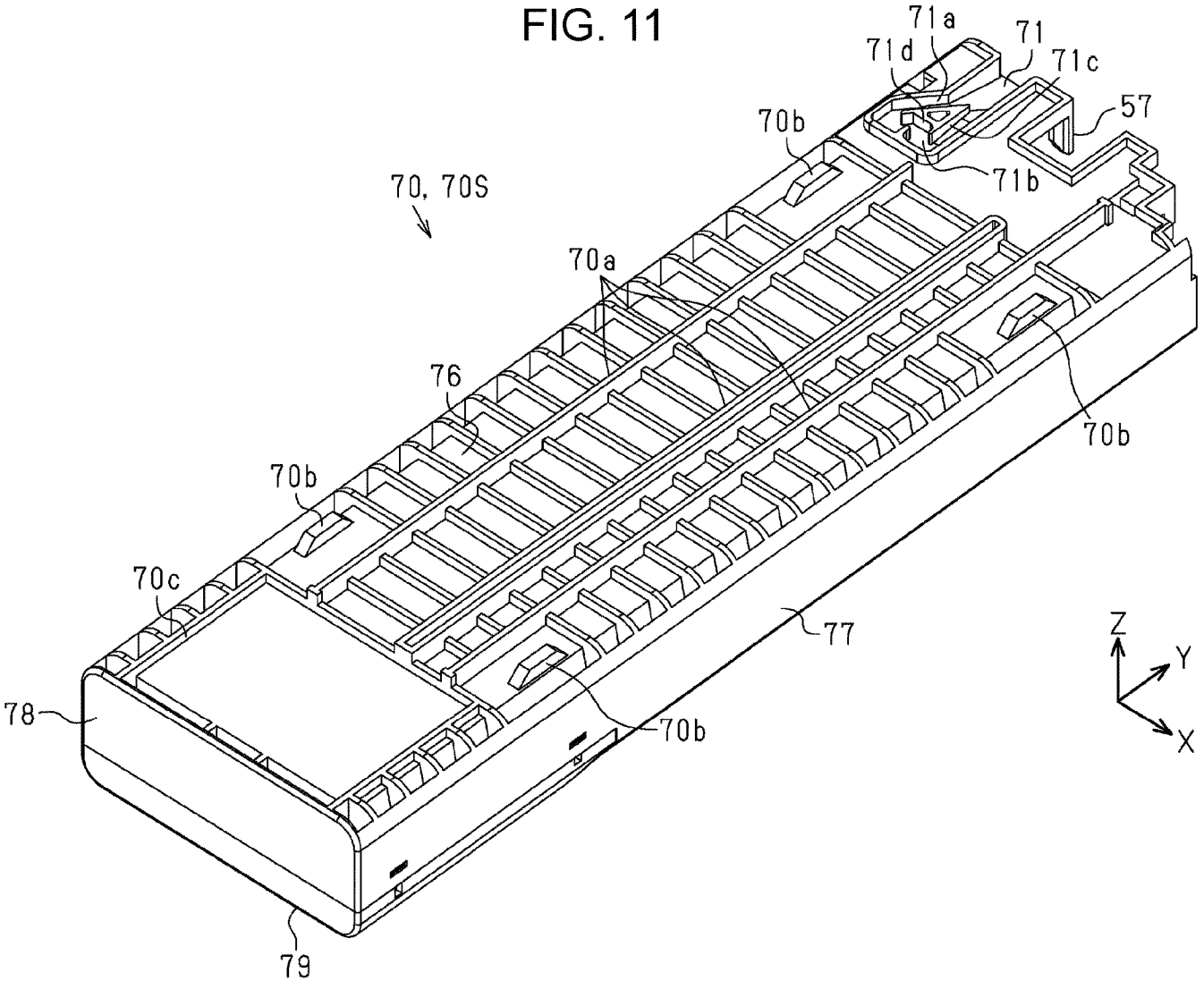
FIG. 11 is a perspective view of the first container of FIG. 6 seen from a bottom surface side.

As illustrated in FIG. 11, to make the container 70 hardly slip, a bottom surface of the bottom plate 76 may be provided with a rib or an embossment, or the hand grip 70*c* may be provided as a recess in the base end portion of the bottom plate 76.

Information indicating the type of the liquid to be supplied by the liquid supplier 60 may be displayed on the liquid supplier 60 or the container 70 to engage with the liquid supplier 60. This may help prevent improper attachment of the liquid supplier 60 or the container 70. Examples of the method of displaying information include sticking a seal or a film describing the information about the type of the liquid, and attaching marks of different shapes for each type of liquid.

If such information is displayed on an outer surface of the container 70, such information may help prevent improper attachment of the container 70 and, if such information is displayed on a top surface of the bottom plate 76, the type of the corresponding liquid is known in a state where the liquid supplier 60 is removed. Therefore, the liquid supplier 60 to be engaged with can be selected easily.

Next, the liquid supplier 60, the container 70, and the attachment 50 with different widths will be described. As illustrated in FIG. 12, the attachment 50 in the present embodiment includes a first attachment 50S and a second attachment 50M with different lengths in the width direction. The container 70 includes a first container 70S and a second container 70M with different lengths in the width direction. The liquid supplier 60 includes a first liquid supplier 60S and a second liquid supplier 60M with different lengths in the width direction and different liquid capacity.

In the present embodiment, the second liquid supplier 60M has higher liquid capacity than the first liquid supplier 60S does, and the second liquid supplier 60M is longer than the first liquid supplier 60S in the width direction. The three first liquid suppliers 60S contain the color ink of cyan, magenta, and yellow, respectively, and a single second liquid supplier 60M contains black ink. The second container 70M is longer than the first container 70S in the width direction. The second attachment 50M in which the second liquid supplier 60M engages with the second container 70M is longer in the width direction than the first attachment 50S in which the first liquid supplier 60S engages with the first container 70S.

In the attachment 50 (50S and 50M), even if the widths (the length in the width direction) of the containers 70 (70S and 70M) differ, arrangement and shape of the connection terminal 53, the identification member 54, the positioning holes 55 and 56, and the urging receiving portion 57 which constitute the connection structure 52, and the position of the engaging groove 71 based on the supply port 51 are the same in all of the containers 79.

Figure 13:
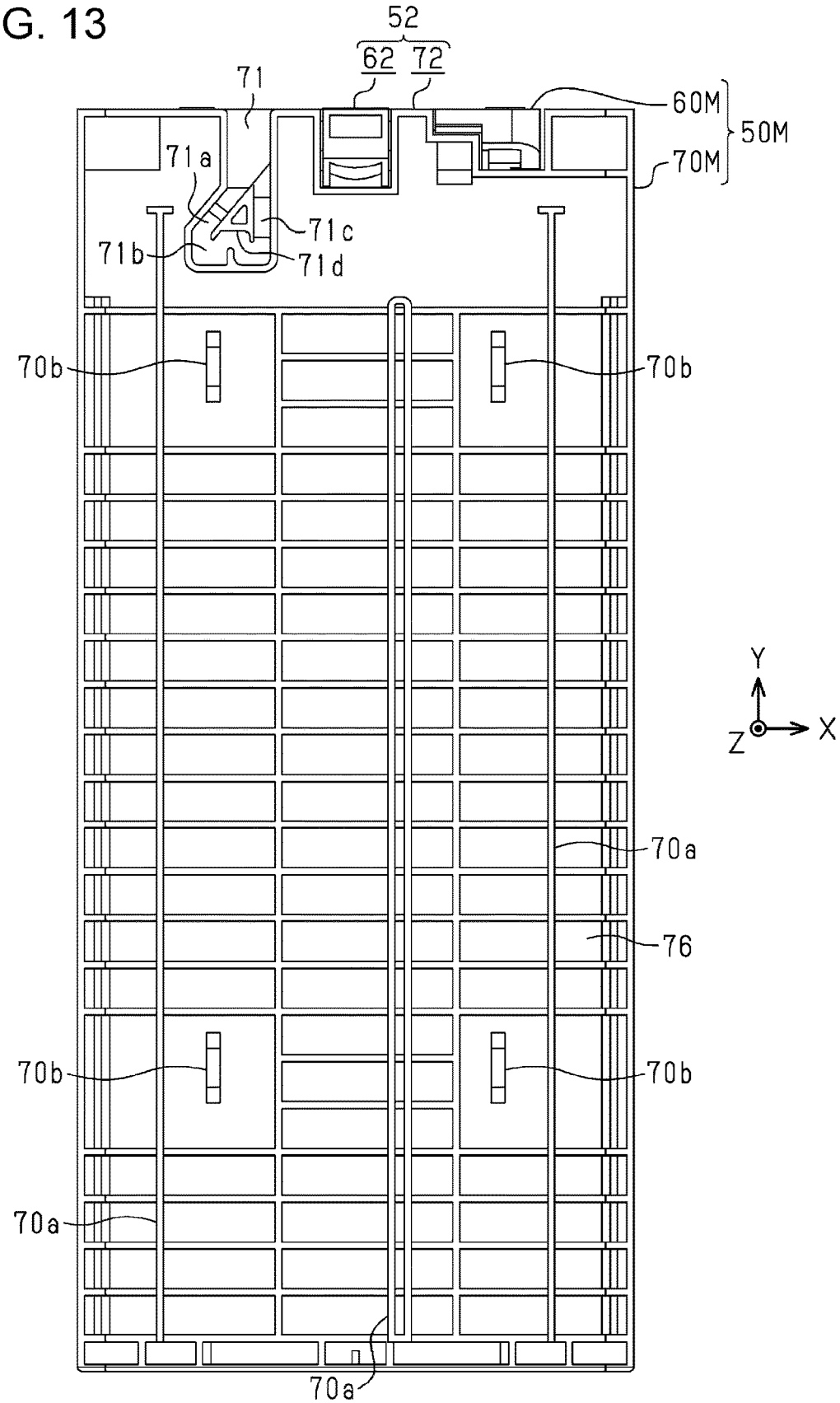
FIG. 13 is a bottom view of the second attachment of FIG. 12.
Figure 14:
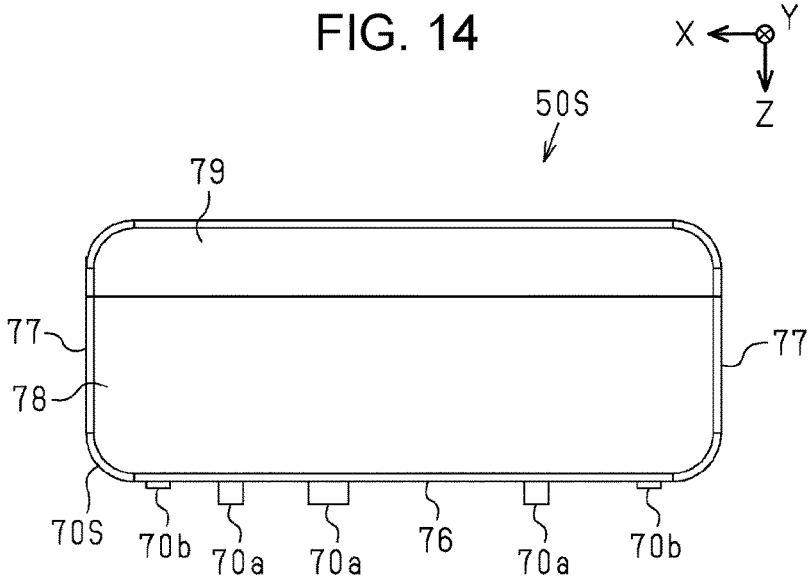
FIG. 14 is a rear view of the first attachment of FIG. 12.
Figure 15:
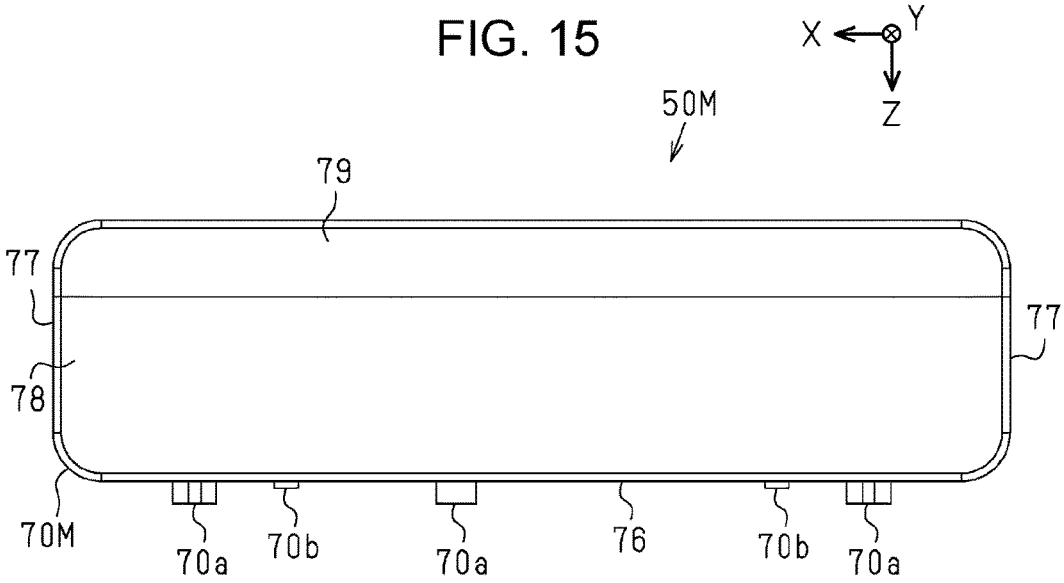
FIG. 15 is a rear view of the second attachment of FIG. 12.
Figure 16:
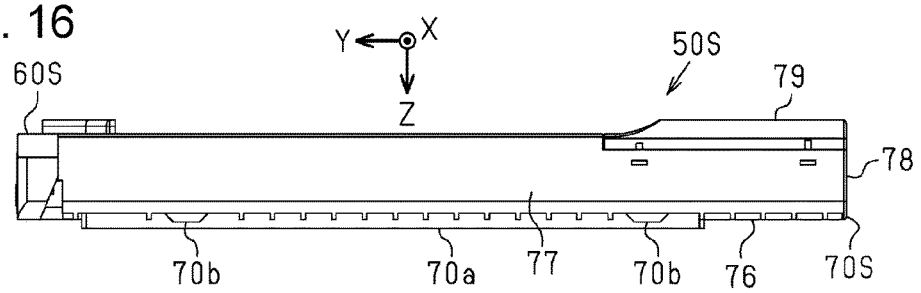
FIG. 16 is a right side view of the first attachment of FIG. 12.
Figure 17:
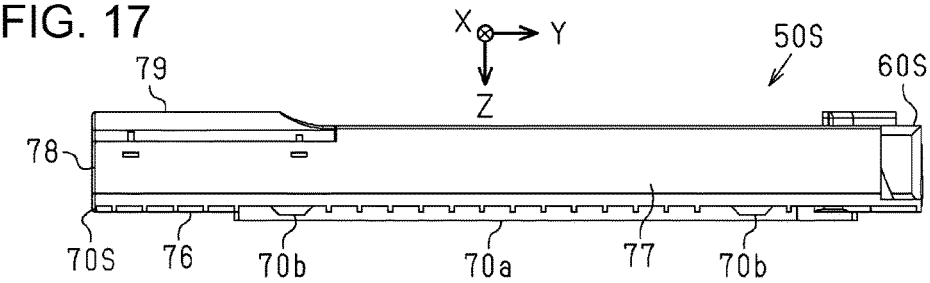
FIG. 17 is a left side view of the first attachment of FIG. 12.
Figure 18:
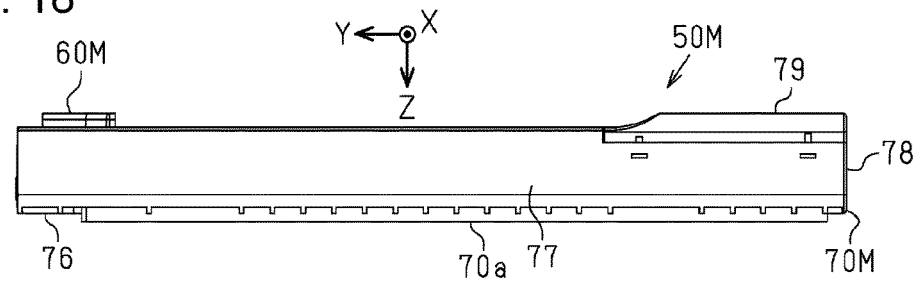
FIG. 18 is a right side view of the second attachment of FIG. 12.
Figure 19:
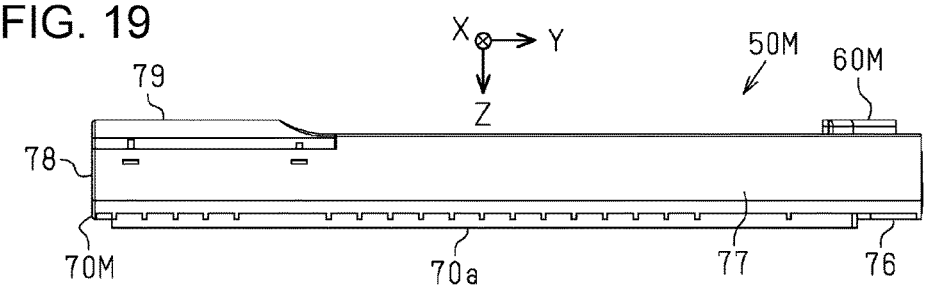
FIG. 19 is a left side view of the second attachment of FIG. 12.
Figure 20:
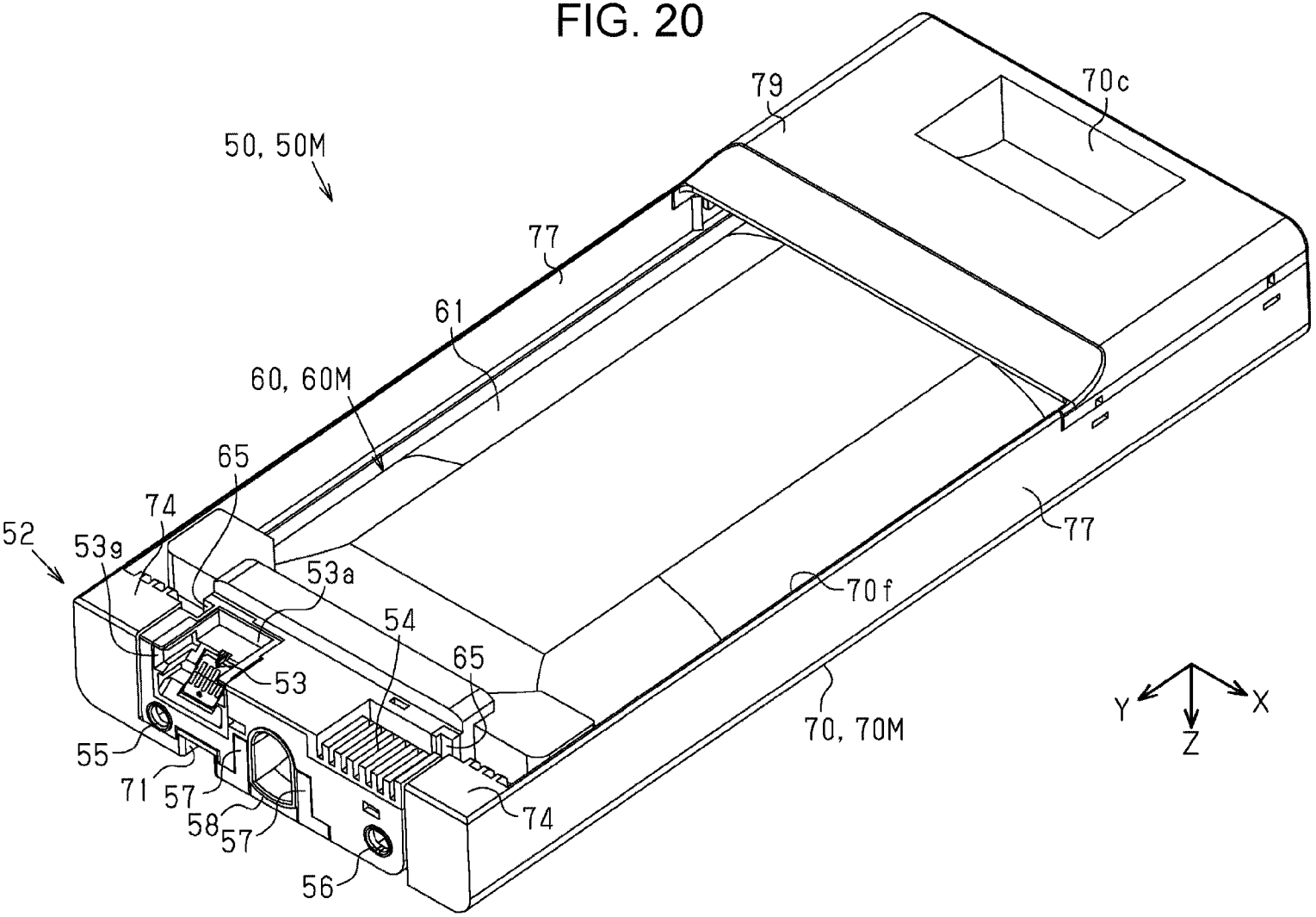
FIG. 20 is a perspective view of the second attachment of FIG. 12.

As illustrated in FIG. 13, in the second container 70M which constitutes the second attachment 50M, the shape of the engaging groove 71 is the same as that of the engaging groove 71 of the first container 70S illustrated in FIG. 10. As illustrated in FIGS. 14 and 15, the first container 70S which constitutes the first attachment 50S and the second container 70M which constitutes the second attachment 50M are the same in height (the length in the vertical direction).

As illustrated in FIGS. 16 to 19, the first container 70S which constitutes the first attachment 50S and the second container 70M which constitutes the second attachment 50M are the same in depth (the length in the attaching direction). As illustrated in FIGS. 20 to 23, the engaging portion 62 of the second liquid supplier 60M engages with the engaging-portion-receiving portion 72 of the second container 70M to constitute the second attachment 50M.

Figure 21:
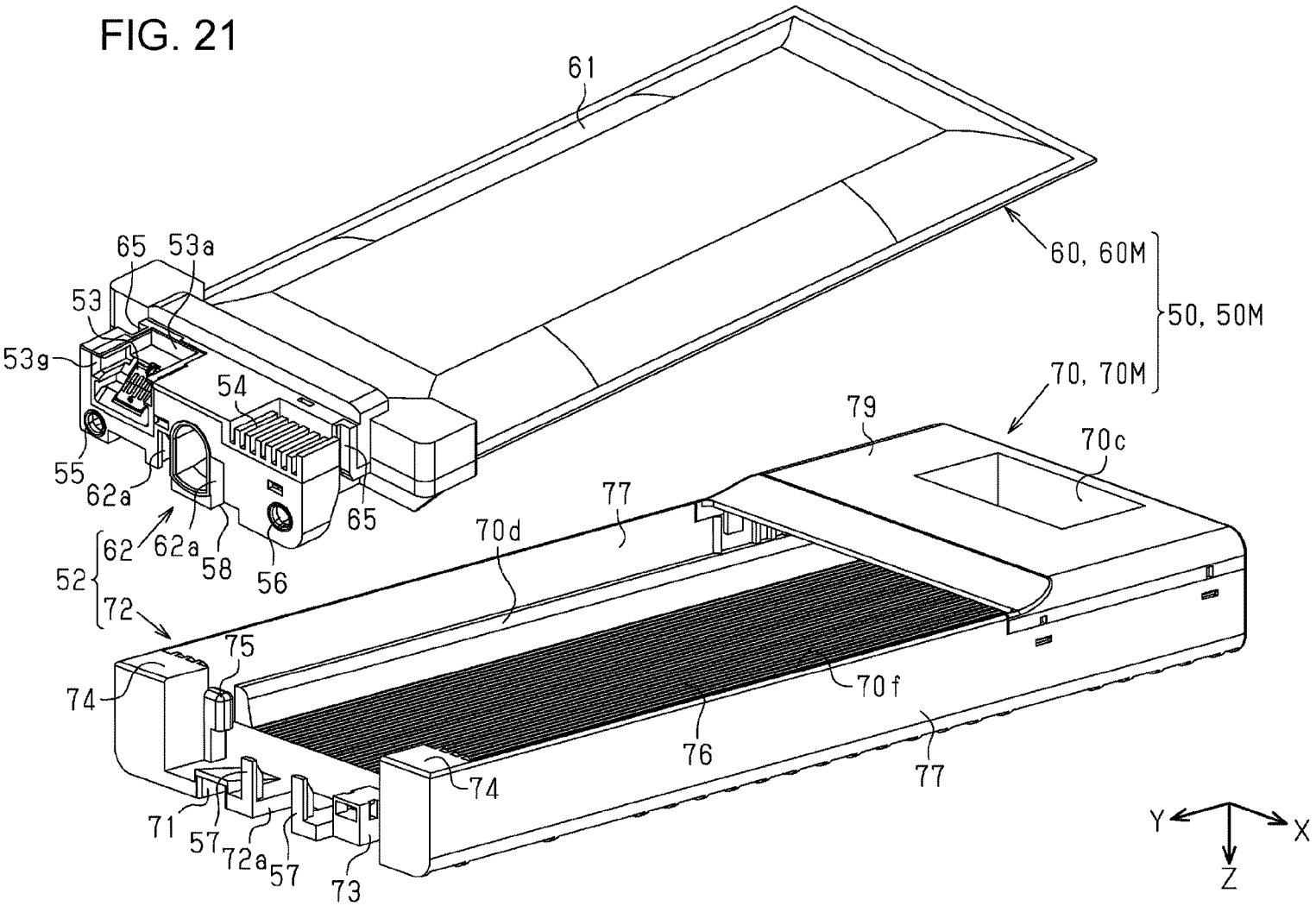
FIG. 21 is a perspective view of a second liquid supplier and a second container which constitute the second attachment of FIG. 12.
Figure 22:
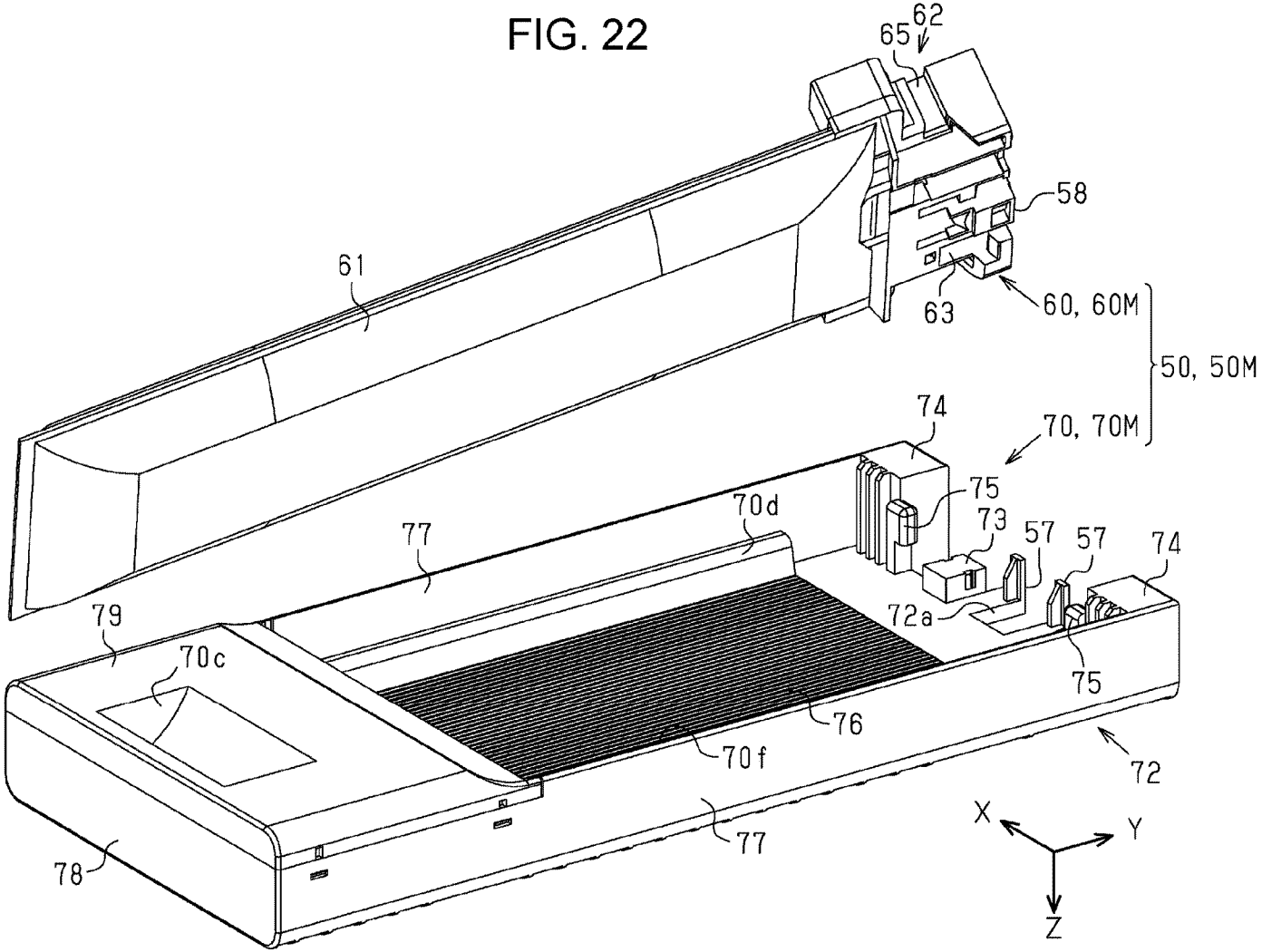
FIG. 22 is a perspective view of the second liquid supplier and the second container of FIG. 21 seen from another angle.
Figure 23:
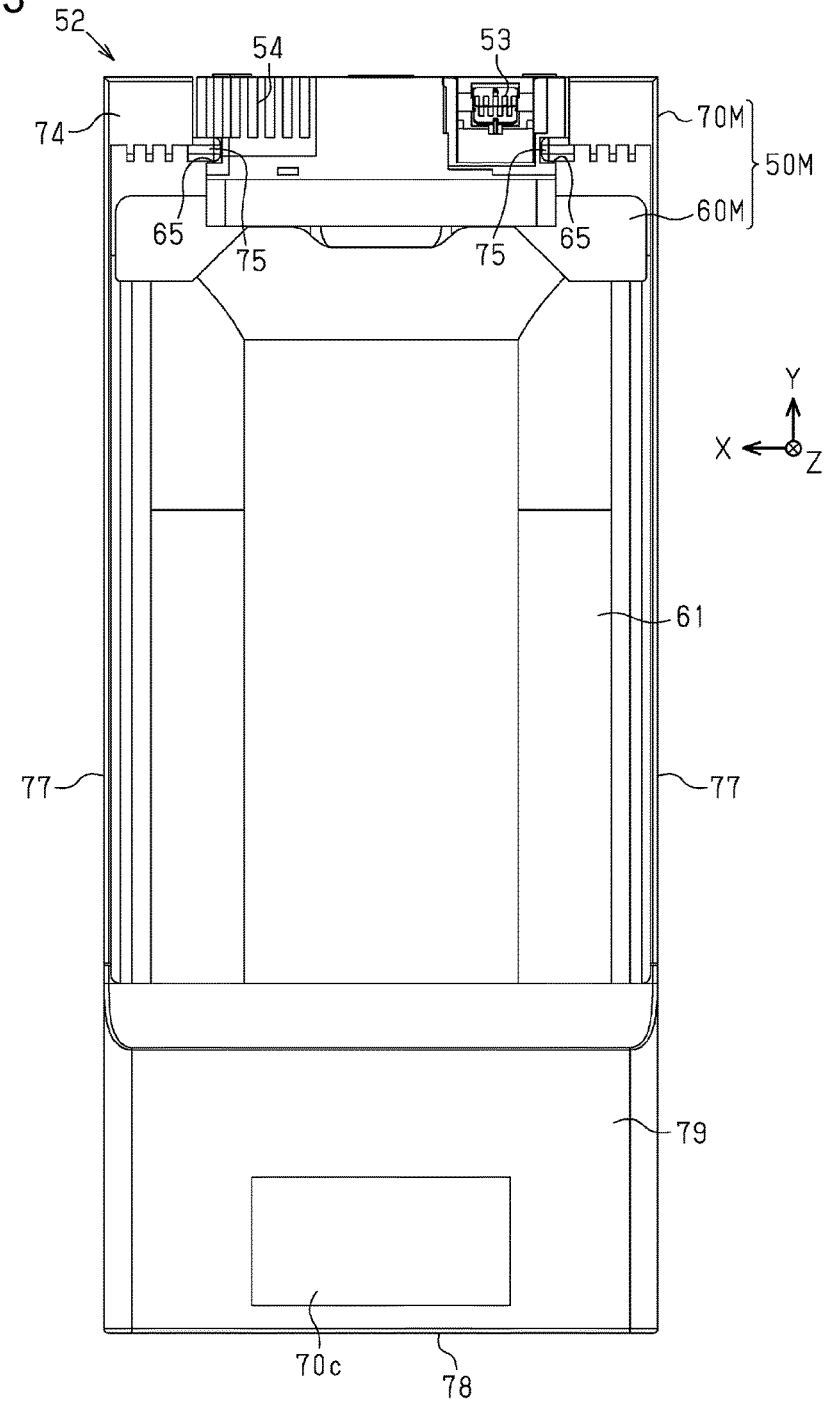
FIG. 23 is a top view of the second attachment of FIG. 12.
Figure 24:
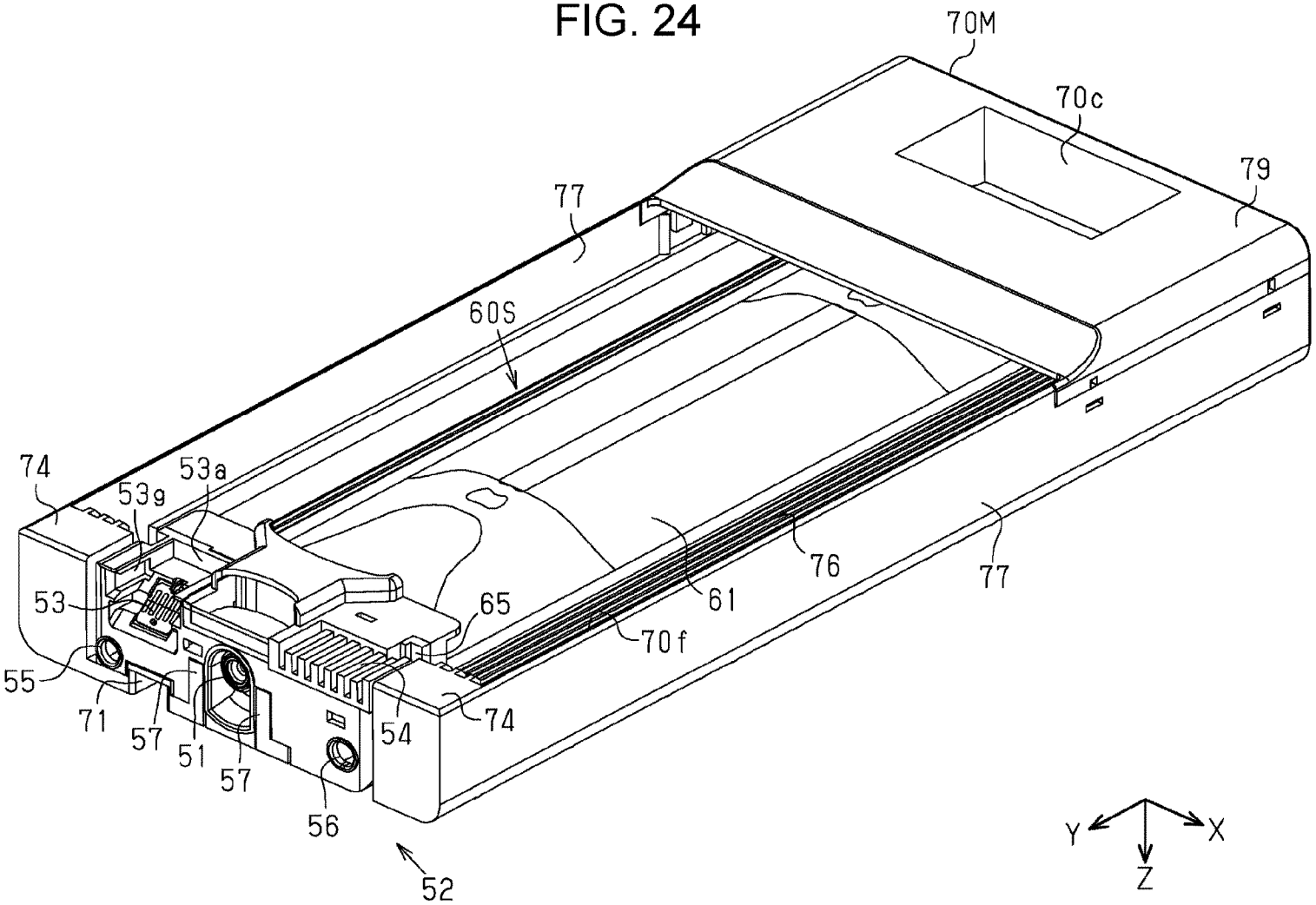
FIG. 24 is a perspective view of an attachment constituted by the second container of FIG. 21 and the first liquid supplier of FIG. 6.
Figure 25:
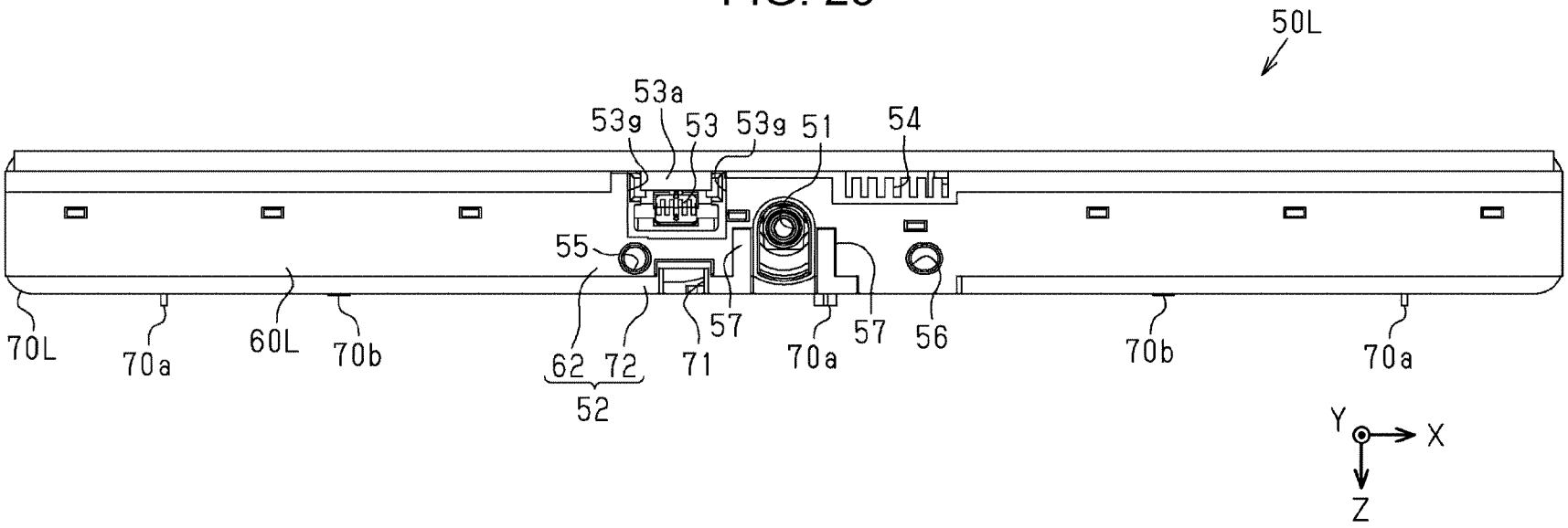
FIG. 25 is a front view of a third attachment.

As illustrated in FIG. 24, the second container 70M may be attached to the attaching portion 13 (see FIG. 9) with the engaging portion 62 of the first liquid supplier 60S engaging with the engaging-portion-receiving portion 72 of the second container 70M. If the engaging portion 62 of the first liquid supplier 60S is to engage with the engaging-portion-receiving portion 72 of the second container 70M, as illustrated in FIGS. 21 and 22, in the second container 70M, holding side portions 74 may be provided adjacent to each other on both sides of the engaging-portion-receiving portion 72 in the width direction. The holding side portions 74 extend in the width direction from the front ends of the side plates 77. The guide portions 75 may be disposed at the holding side portions 74.

As illustrated in FIGS. 25 to 32, a third liquid supplier 60L as the liquid supplier 60 may be used as a third attachment 50L as the attachment 50 in combination with a third container 70L as the container 70. The third liquid supplier 60L is a large-capacity liquid supplier 60 having greater capacity of the liquid than that of the small-capacity first liquid supplier 60S and the medium-capacity second liquid supplier 60M. The third container 70L is a large-sized container 70 having a width greater than those of the small-sized first container 70S and the middle-sized second container 70M. The large-capacity third liquid supplier 60L may contain black ink, for example, and may be used for monochrome printing.

The third attachment 50L may also be attached to the attaching portion 13 by setting arrangement and shape of the connection terminal 53, the identification member 54, the positioning holes 55 and 56, the urging receiving portion 57, and the engaging groove 71 which constitute the connection structure 52 based on the supply port 51 to be the same as those of the first attachment 50S and the second attachment 50M. If the third attachment 50L is attached, the entire accommodation space of the attaching portion 13 illustrated in FIG. 9 may be used. Alternatively, another attaching portion 13 may be disposed on the attaching portion 13 illustrated in FIG. 9 in the vertical direction, and a single connecting portion 36 and a single connection mechanism 80 may be disposed near the center of the another attaching portion 13 in the width direction, and the third attachment 50L may be attached.

Figure 33:
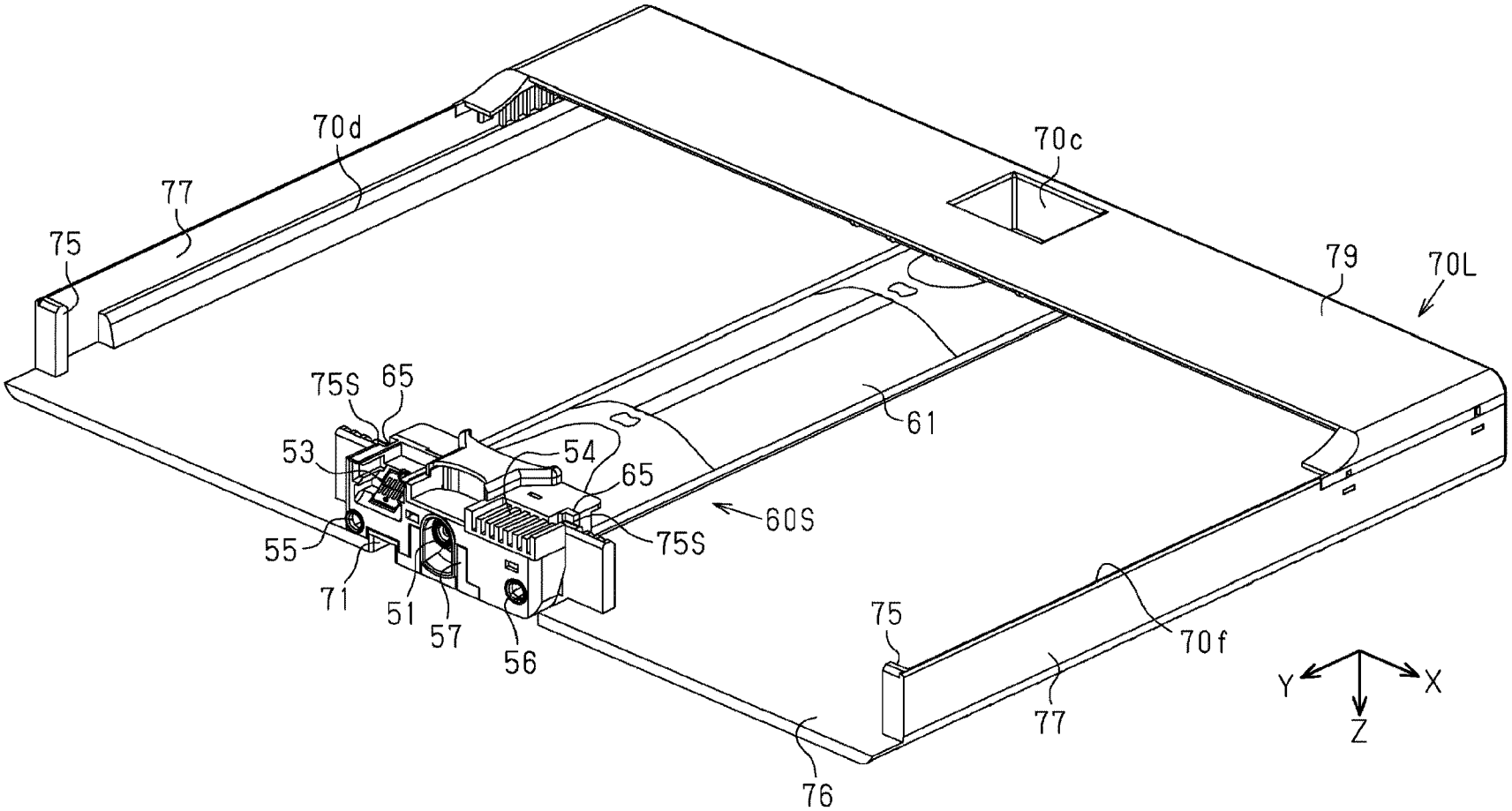
FIG. 33 is a perspective view of an attachment constituted by the third container of FIG. 25 and the first liquid supplier of FIG. 6.

As illustrated in FIG. 33, the small-capacity first liquid supplier 60S may engage with the large-sized third container 70L, and may be attached to the attaching portion 13. Similarly, as illustrated in FIG. 34, the medium-capacity second liquid supplier 60M may engage with the large-sized third container 70L, and may be attached to the attaching portion 13.

Figure 32:
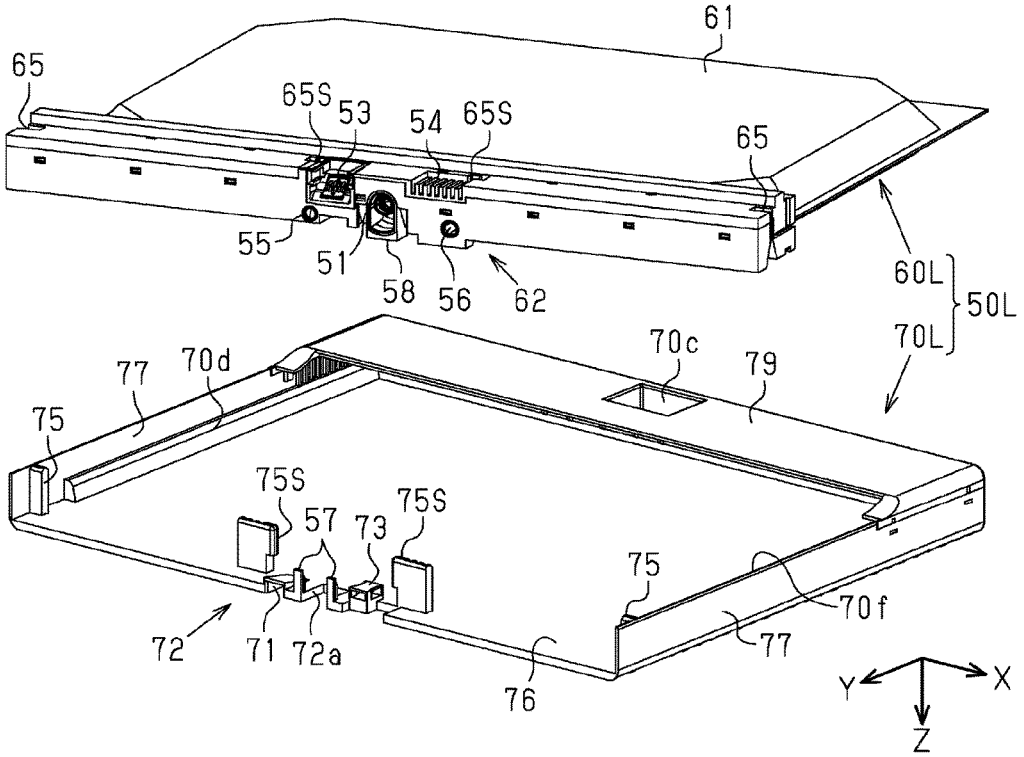
FIG. 32 is a perspective view of a third liquid supplier and a third container which constitute the third attachment of FIG. 25.
Figure 34:
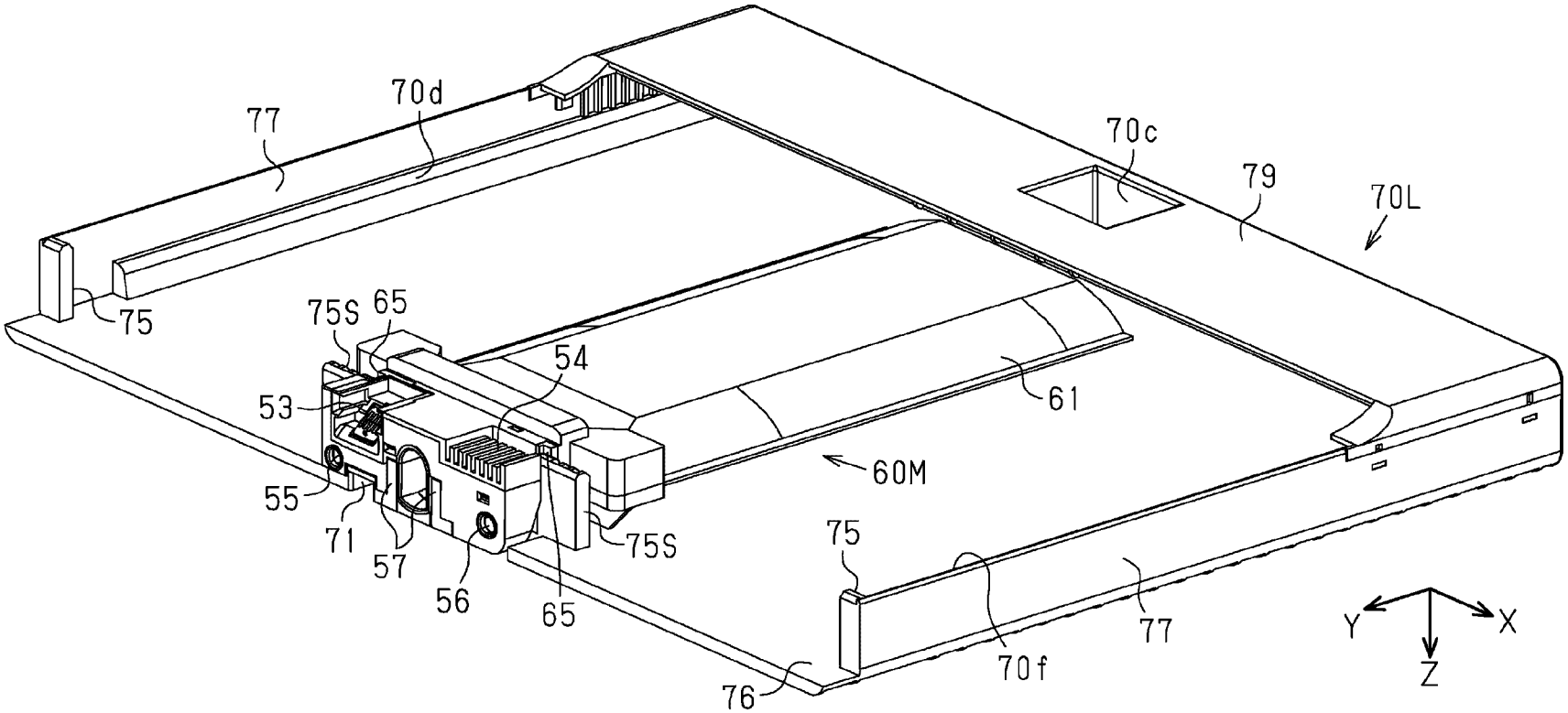
FIG. 34 is a perspective view of an attachment constituted by the third container of FIG. 25 and the second liquid supplier of FIG. 21.

In the case where the liquid suppliers 60S and 60M are to engage with the third container 70L, it may be desirable that, in the third container 70L, as illustrated in FIGS. 32 to 34, the guide portions 75 for engaging with the third liquid supplier 60L are provided at the front ends of the side plate 77, and guide portions 75S for engaging the liquid suppliers 60S and 60M are provided to stand upright at a front end portion of the bottom plate 76.

Figure 26:
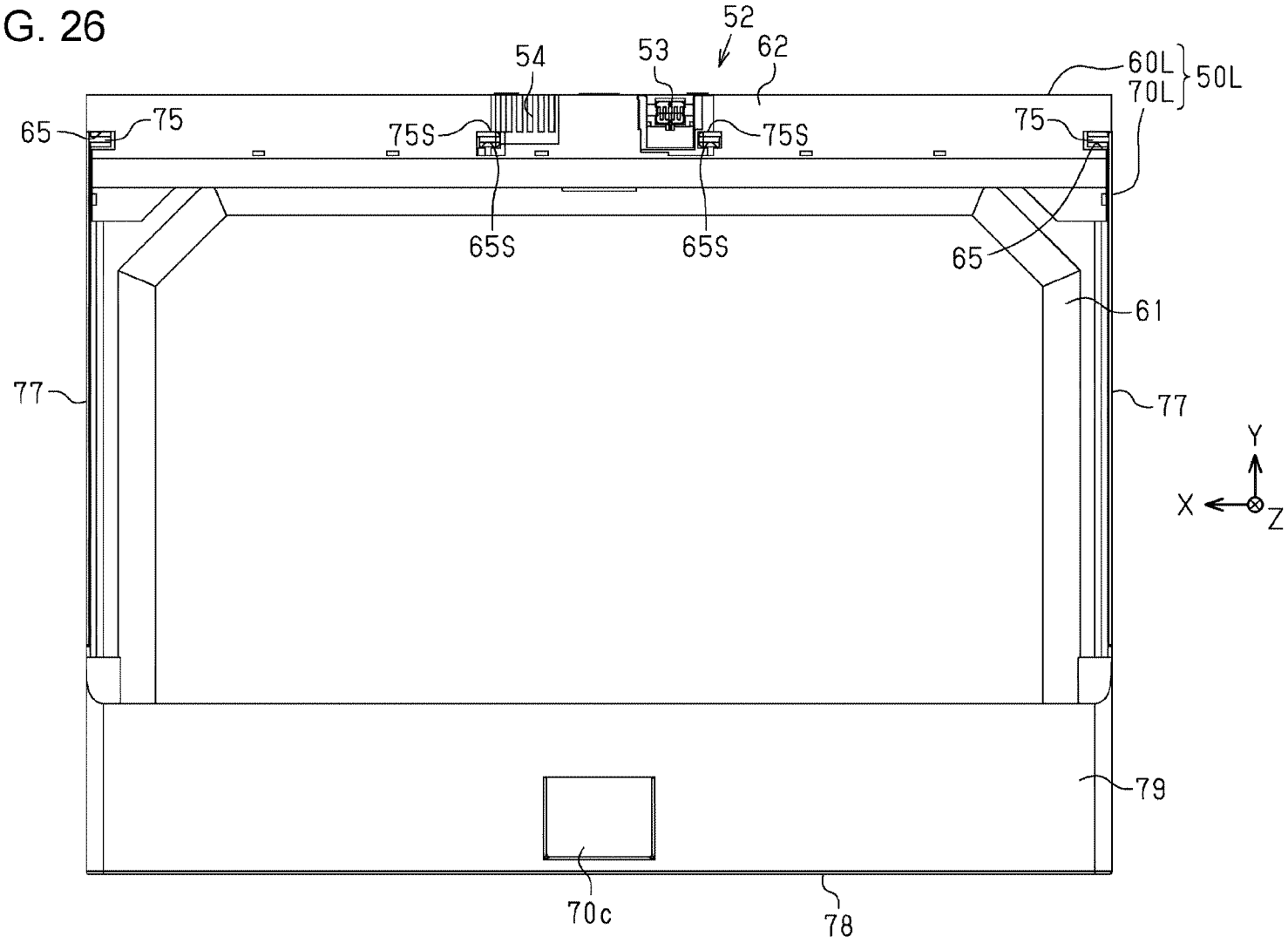
FIG. 26 is a top view of the third attachment of FIG. 25.
Figure 27:
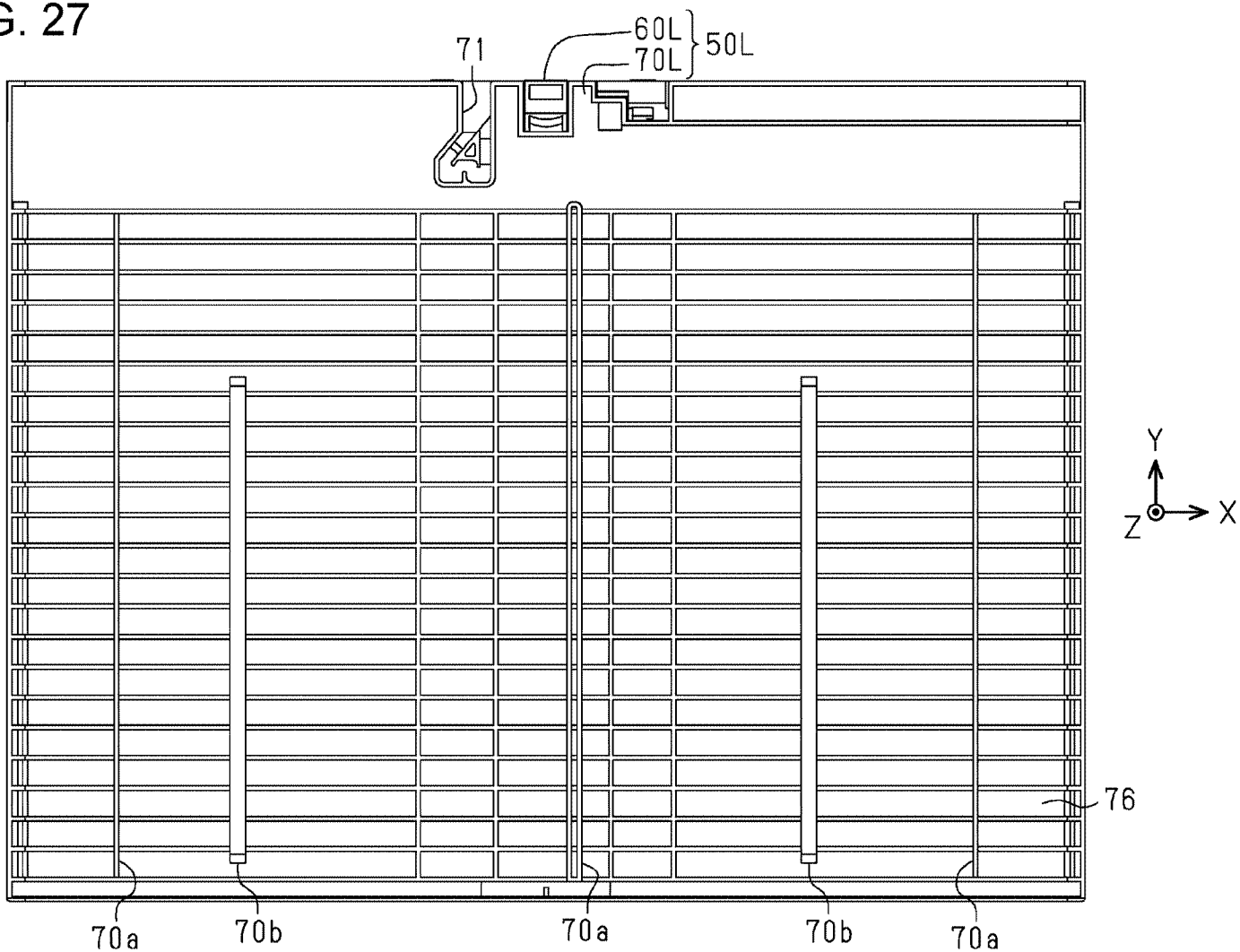
FIG. 27 is a bottom view of the third attachment of FIG. 25.
Figure 28:
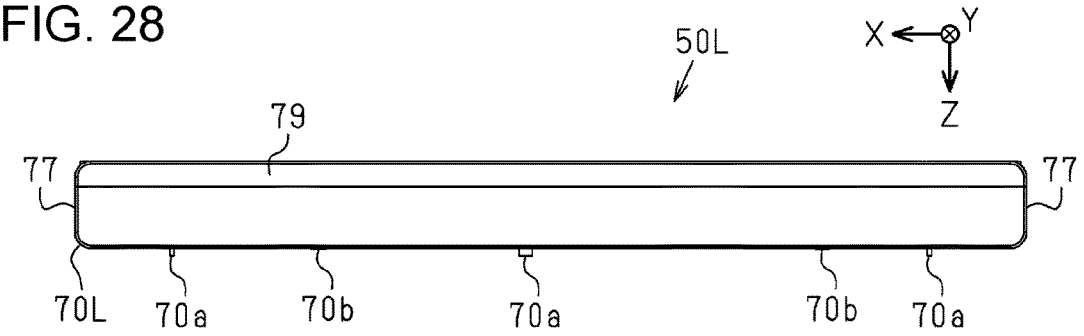
FIG. 28 is a rear view of the third attachment of FIG. 25.
Figure 29:
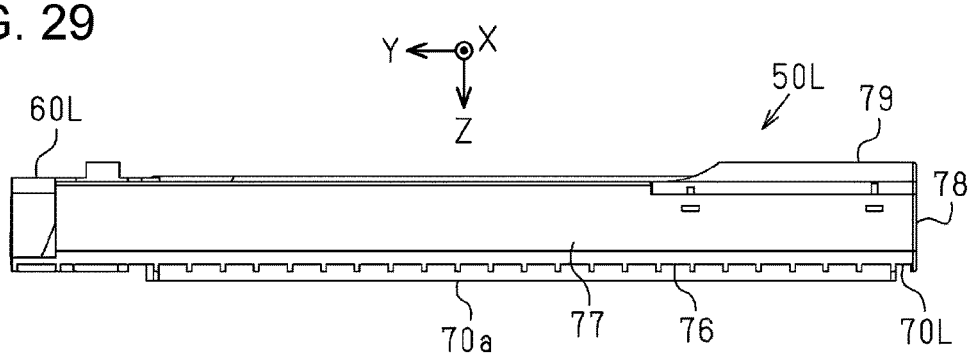
FIG. 29 is a right side view of the third attachment of FIG. 25.
Figure 30:
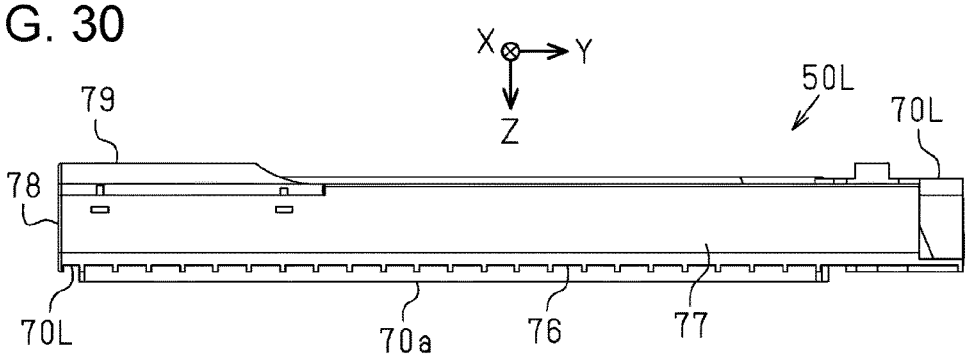
FIG. 30 is a left side view of the third attachment of FIG. 25.
Figure 31:
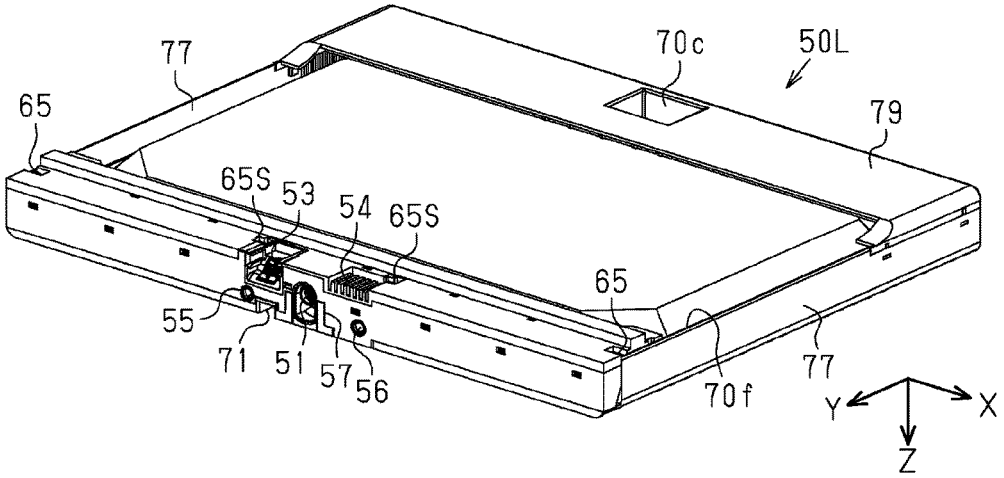
FIG. 31 is a perspective view of the third attachment of FIG. 25.

As illustrated in FIGS. 26 and 32, it may be desirable that, in the third liquid supplier 60L, the engaging recesses 65 to engage with the guide portions 75 are provided at the front ends of the side plates 77, and engaging recesses 65S to engage with the guide portions 75S are provided.

As illustrated in FIG. 9, to reduce sliding resistance when the container 70 is moved along the frame 21, rollers 21*c* may be disposed at positions, for example, over which legs 70*b* pass in the movement path of the container 70. Especially if the large-sized third attachment 50L is to be attached, such a heavy third attachment 50L may be easily moved with the existence of the rollers 21*c*.

Next, an effect of the thus-configured liquid ejecting apparatus 11 will be described. The liquid supplier 60 for supplying the liquid to be ejected by the liquid ejecting head 32 to the liquid ejecting apparatus 11 is attached to the attaching portion 13 in a state stored in the storing space of the container 70 with the movement of the container 70.

The container 70 and the liquid supplier 60 are flat in shape of which the height (the vertical length) among the lengths in depth, width, and height is the shortest. The liquid container 61 of the liquid supplier 60 is accommodated in the container 70 with a flat orientation with the height among the lengths in depth, width, and height being the shortest. Since a plurality of such containers 70 are arranged in the width direction in the attaching portion 13, the attaching portion 13 is the shortest in height among the lengths in depth, width, and height. Therefore, the height of the liquid ejecting apparatus 11 is reduced.

If the attaching portion 13 is provided on the side of the exterior body 12 or at a position horizontally adjacent to the transportation path of the medium S inside the exterior body 12, the width or the depth of the liquid ejecting apparatus 11 increases depending on the size of the liquid container 61, and a floor area required to install the liquid ejecting apparatus 11 is increased accordingly. In that respect, in the present embodiment, since the attaching portion 13 is disposed adjacent to the transportation path of the medium S in the vertical direction, an increase in the width or the depth in the liquid ejecting apparatus 11 can be prevented.

Since the container 70 can be attached to the attaching portion 13 with no liquid supplier 60 contained therein, the container 70 may be attached to the attaching portion 13 in an empty state when no liquid supplier 60 is contained therein. If the liquid supplier 60 and the container 70 have different widths, the liquid supplier 60 and the container 70 may be attached by changing combinations in the common configurations of the engaging portion 62 and the engaging-portion-receiving portion 72.

According to the embodiment, the following effects can be obtained.

(1) Since the engaging portion 62 of the liquid supplier 60 engages with the engaging-portion-receiving portion 72 to be relatively movable in the direction which crosses the movement path when the container 70 is attached to the attaching portion 13, even if the position of the container 70 is moved during attachment to the attaching portion 13, the liquid supplier 60 moves relative to the container 70 and the position of the liquid supplier 60 can be adjusted. Therefore, the liquid supplier 60 may be properly attached with the movement of the container 70.

(2) Since the latching portion 82 provided in the attaching portion 13 latches the container 70, movement of the liquid supplier 60 in the direction to separate from the attaching portion 13 can be prevented without fixing the liquid supplier 60 to the attaching portion 13.

(3) Since the engaging portion 62 of the liquid supplier 60 engages with the engaging-portion-receiving portion 72 of the container 70, even if the liquid supplier 60 receives a reaction during attachment, movement of the liquid supplier 60 in the direction toward the starting end of the movement path within the container 70 can be prevented. For example, when the engaging portion 62 engages with the engaging-portion-receiving portion 72, a gap is formed between the engaging recess 65 and the guide portion 75 so that the engaging portion 62 is not substantially moved in the attaching direction. Upon attachment of the container 70 to the attaching portion 13, the engaging portion 62 of the liquid supplier 60 is located at the front end portion. It is therefore possible that the liquid supplier 60 receives a reaction during attachment and is moved in the direction to separate from the attaching portion 13. In that respect, since the engaging-portion-receiving portion 72 of the container 70 has the urging receiving portion 57 as the engagement projection to engage with the end surface of the engaging portion 62, the movement of the liquid supplier 60 in the direction to separate from the attaching portion 13 can be prevented by the urging receiving portion 57 which is a part of the engaging-portion-receiving portion 72 receiving a reaction instead of the liquid supplier 60.

(4) Since the engaging portion 62 is moved along a pair of guide portions 75 arranged in the width direction, the liquid supplier 60 can be made to engage with the container 70 at a proper position.

(5) In the container 70, since the shape of the engaging-portion-receiving portion 72 with which the engaging portion 62 engages differs between a first side and a second side in the width direction, the engaging portion 62 does not engage in an improper direction. Therefore, the liquid supplier 60 can be inserted into the container 70 in a proper direction.

(6) Since the urging portion 87*c* provided in the attaching portion 13 urges the attached container 70 toward the starting end of the movement path, the container 70 can be easily removed from the attaching portion 13.

(7) When the positioning projections 85 and 86 engage with the liquid supplier 60 moving toward the connecting portion 36, the movement of the liquid supplier 60 in the direction crossing the movement path during attachment of the container 70 to the attaching portion 13 is limited. Therefore, after positioning of the liquid supplier 60 by the positioning projections 85 and 86, the liquid supplier 60 can be properly connected to the connecting portion 36.

(8) When the liquid supplier 60 is stored in the container 70 and the container 70 is attached to the attaching portion 13, the liquid supplier 60 in the storing space is covered with the cover 79 and, therefore, the liquid supplier 60 does not easily protrude from the storing space. Therefore, occurrence of defective attachment caused when the liquid supplier 60 protruding from the container 70 touches other members in the movement path of the container 70 can be prevented. Accordingly, the liquid supplier 60 accommodated in the container 70 can be properly attached with the movement of the container 70.

(9) The opening 70*f* of the container 70 opens in the different direction from the direction in which the container 70 moves upon attachment to the attaching portion 13. Therefore, if the liquid supplier 60 protrudes from the opening 70*f*, the liquid supplier 60 may easily touch other members in the movement path of the container 70. Therefore, occurrence of defective attachment caused by protrusion of the liquid supplier 60 can be effectively prevented by covering the opening 70*f* with the cover 79 during attachment and removal of the container 70.

(10) The cover 79 of the container 70 includes projections 59*c* projecting toward the storing space. The projections 59*c* press the liquid supplier 60 stored in the storing space whereby an unnecessary movement or excessive deformation of the liquid supplier 60 in the storing space can be prevented.

(11) Since a part of the base end side of the storing space of the container 70 is covered with the cover 79, the cover 79 covers an end of the liquid supplier 60 on a base end side when the liquid supplier 60 is stored in the storing space. Therefore, the base end of the liquid supplier 60 does not protrude from the storing space when the container 70 is removed from the attaching portion 13.

(12) The container 70 in which the liquid supplier 60 is accommodated is longer in width than in height among the lengths of height, depth, and width. Since a plurality of containers 70 are arranged in the width direction in the attaching portion 13 to which the container 70 is attached, the apparatus can be reduced in height.

(13) Since the second container 70M which is longer in width is attached closer to an end in the width direction than the first container 70S is, the center of gravity of the attaching portion 13 which supports the load of the attached container 70 and the attached liquid supplier 60 may be located closer to the end in the width direction. Therefore, flexure of the attaching portion 13 which supports the load of the attached container 70 and the attached liquid supplier 60 can be prevented.

(14) Although the attaching portion 13 in which a plurality of wide containers 70 are attached becomes long in the width direction, both ends in the width direction of the frame 21 which constitutes the attaching portion 13 can be supported efficiently by the support portions 12*a*.

(15) If distances of the guide rails 23 which guide the movement of the containers 70 to be attached are set to differ for each width of the container 70, errors in attachment positions of the containers 70 of different width do not easily occur.

(16) If distances of a plurality of sets of guide rails 23 which guide the movement of the containers 70 to be attached to the attaching portion 13 are set to differ from one another, errors in attachment positions of the containers 70 of the same width do not easily occur.

(17) The medium container 14 which accommodates the medium S has a predetermined width, but the width of the attaching portion 13 is longer than that of the medium container 14. Therefore, a liquid supplier 60 which is longer in width, or a greater number of the liquid suppliers 60 may be attached.

(18) The partition walls 21*b* which divide, in the width direction, the accommodation space formed by the frame 21 are disposed vertically below the medium container 14. The load of the medium container 14 can be supported by the partition walls 21*b*. Therefore, complication and an increase in size of the apparatus caused by addition of a reinforcing member for supporting the medium container 14 can be prevented.

The above embodiment may be changed as alternative embodiments described below. Each component constituting the liquid ejecting apparatus 11 of the above embodiment, each alternative embodiment, and each component constituting the alternative embodiment may be combined with one another.

The engaging groove 71 provided in the container 70 is not limited to a heart cam groove. For example, the engaging groove 71 may be a recess with which a lever operable from outside engages. When the lever is operated from outside, engagement with the recess may be released. Alternatively, a stopper for preventing movement of the container 70 attached to the attaching portion 13 in the removing direction may be provided near the insertion port 22 to maintain the state that the container 70 is attached to the attaching portion 13.

The container 70 may include a front plate extending upward from the bottom plate 76 on the front end side so that the container 70 is box-shaped which opens only upward. In this case, a through hole may desirably be formed in the front plate through which the supply port 51 of the liquid supplier 60 is connected to the connecting portion 36.

In the container 70, the engaging-portion-receiving portion 72 may be formed as an engaging member provided separately from the bottom plate 76 or the side plates 77. The separately provided engaging member may be attached to the bottom plate 76 or the side plates 77 and may receive engagement of the engaging portion 62. Alternatively, the engaging portion 62 may engage the separately provided engaging member with the bottom plate 76 or the side plates 77.

The cover 79 of the container 70 may be attached to and removed from the main body constituted by the bottom plate 76, the side plates 77, and the front plate 78, or may slide along an upper end portion of the main body to open and close the opening 70*f* through which the liquid supplier 60 is placed or removed. That is, the cover 79 may be attached to be movable relative to the main body of the container 70 and, may desirably be disposed at a position to cover at least a part of the liquid supplier 60 accommodated in the accommodation space at least during attachment to and removal from the attaching portion 13. Therefore, if the cover 79 is provided to be movable relative to the main body or attached to or removed from the main body, the cover 79 may desirably cover the entire opening 70*f*.

If the cover 79 of the container 70 is attached to be movable relative to the main body which forms the storing space, the liquid supplier 60 stored in the storing space may be covered with the cover 79 when the container 70 is attached to or removed from the attaching portion 13, and the cover 79 may be moved to a position at which the cover 79 does not disturb the movement when the liquid supplier 60 is placed in or removed from the storing space.

The cover 79 of the container 70 may be disposed at a position to cover a part of the front end side of the storing space. In this case, the cover 79 is desirably provided to be attached to or removed from the main body of the container 70, or to be movable relative to the main body.

With this configuration, since protrusion of the liquid supplier 60 from the storing space at a position on the rear side of the attaching portion 13 and which is not easily visible is prevented, occurrence of defective attachment can be prevented effectively.

The cover 79 of the container 70 may be disposed to cover a center portion of the storing space in the depth direction. In this case, the cover 79 is desirably provided to be attached to or removed from the main body of the container 70, or to be movable relative to the main body.

With this configuration, in a case where the liquid container 61 is a flexible bag, since a portion which swells to the largest with the contained liquid can be pressed by the cover 79, occurrence of defective attachment can be prevented effectively.

Figure 35:
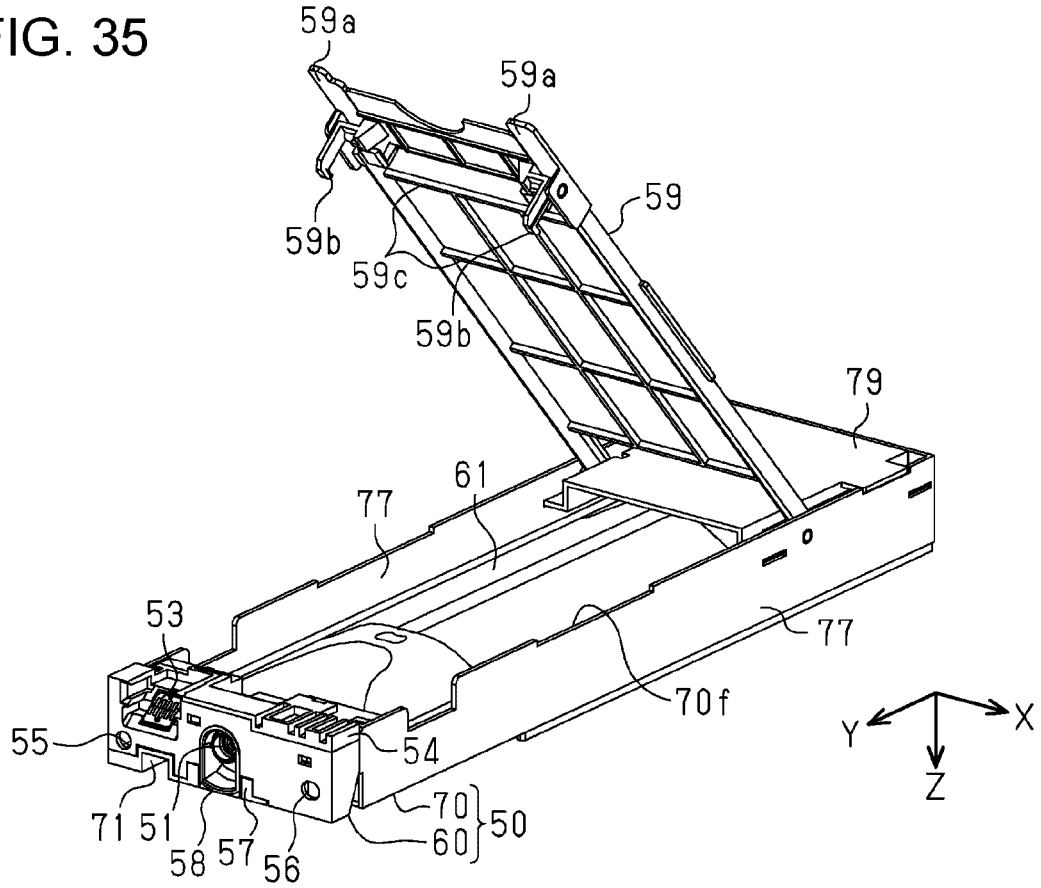
FIG. 35 is a perspective view of an attachment constituted by a container provided with an opening/closing cover, and a liquid supplier.

As illustrated in FIG. 35, no hand grip 70*c* may be provided in the cover 79 of the container 70. As illustrated in FIG. 35, the container 70 may include the cover 79 for covering a part of the storing space which stores the liquid supplier 60, and an opening/closing cover 59 for opening and closing the opening 70*f* through which the liquid supplier 60 is placed or removed. The opening/closing cover 59 may cover the entire or a part of the opening 70*f*. Pressing portions 59*a* for pressing the engaging portion 62 of the liquid supplier 60 which has engaged with the container 70 may be provided in the opening/closing cover 59.

If the container 70 includes the opening/closing cover 59 for opening and closing the opening 70*f*, the liquid supplier 60 can be placed in or removed from the storing space through the opening 70*f* when the opening/closing cover 59 is opened and, protrusion of the liquid supplier 60 from the opening 70*f* can be prevented by closing the opening/closing cover 59 when the container 70 is attached to and removed from the attaching portion 13.

The opening/closing cover 59 may include latch projections 59*b* which engage with the main body (for example, the side plates 77) and maintain a closed state. If the opening/closing cover 59 can be latched to the main body, even if the attachment 50 is dropped or the orientation of the attachment 50 is significantly changed during transportation, the latch can keep the engagement between the liquid supplier 60 and the container 70.

The opening/closing cover 59 may be opened and closed by pivoting, sliding, or stretching. The opening/closing cover 59 may include projections 59*c* projecting toward the storing space provided in the container 70. The opening/closing cover 59 is desirably opened and closed by pivoting because the projections 59*c* do not unnecessarily touch the liquid supplier 60 during opening and closing.

Figure 36:
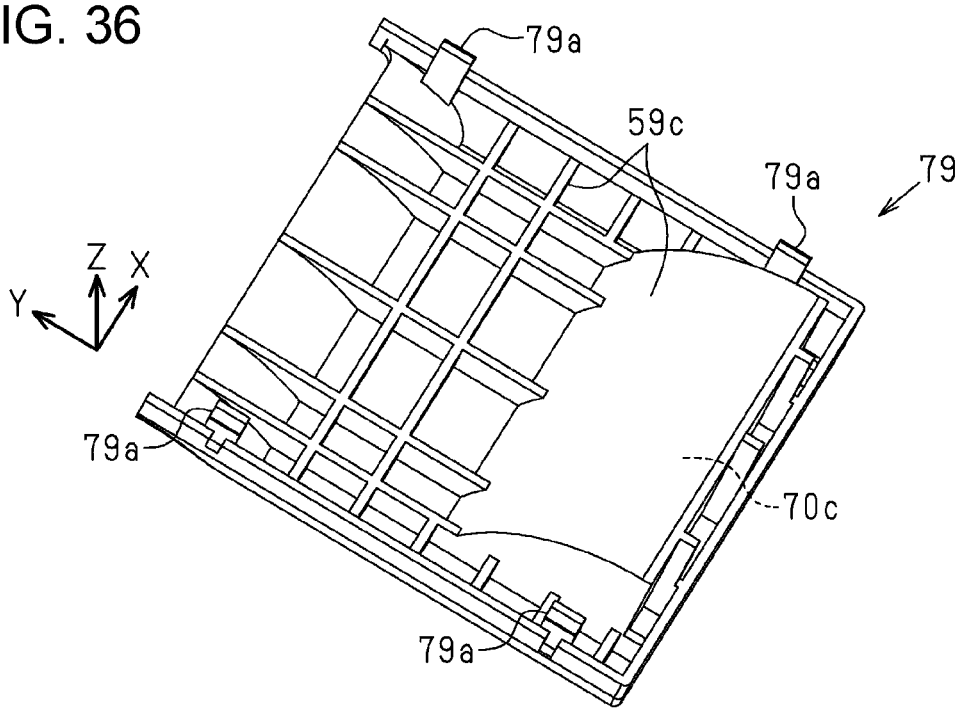
FIG. 36 is a perspective view of a cover provided in the first container illustrated in FIG. 6 seen from a rear side.

As illustrated in FIG. 36, the projections 59*c* projecting toward the storing space may be provided in the cover 79. In this case, a rear side portion of the cover 79 may be used as a projection 59*c* if the hand grip 70*c* is formed as a recess on the front side of the cover 79. If the liquid supplier 60 has the flexible liquid container 61, the shape of the liquid container 61 is changed depending on the conditions when the liquid container 61 is accommodated in the container 70, or depending on the amount of liquid to be contained. As the remaining amount of liquid becomes smaller, an outer edge portion (especially an end on the base end side) may be bent upward and protrude from the opening 70*f*.

Therefore, distal end portions of the projections 59*c* desirably conform to the shape of the liquid container 61 when the amount of liquid in the container 61 is large so as to stabilize orientation and shape of the liquid container 61. The projections 59*c* may be contact portions of size and shape to be in contact with the liquid supplier 60 when the liquid supplier 60 is full, or may be limiting portions projecting to such an extent to be in contact with the liquid container 61 when the liquid container 61 is excessively deformed or displaced. For example, the distal end portions of the projections 59*c* may be formed as contact portions curved to conform to the shape of the fully-packed liquid container 61. Even if the liquid container 61 is significantly deformed during accommodation in the liquid supplier 60, the deformation can be corrected in contact with the contact portions and the liquid container 61 can be placed in the storing space.

A pressing member which compresses the flexible liquid container 61 (for example, a plate spring or a compression spring made of resin or metal) may be disposed in the storing space of the container 70. The pressing member may desirably be attached to the cover 79 or the opening/closing cover 59 which moves relatively. Then, pressing force by the pressing member can be applied to the liquid container 61 after the liquid container 61 is stored in the storing space. By pressing the liquid container 61 with the pressing member, the liquid contained in the liquid container 61 can be made to flow into the supply flow channel 35. In this case, the liquid ejecting apparatus 11 does not necessarily have to include the supply mechanism 41. Also in a case where the liquid ejecting apparatus 11 includes the supply mechanism 41, since the liquid container 61 is pressed by the pressing member, the amount of remaining liquid is reduced by the reaction force of the film which constitutes the bag or the like, and the liquid contained in the liquid container 61 can be used up.

Figure 37:
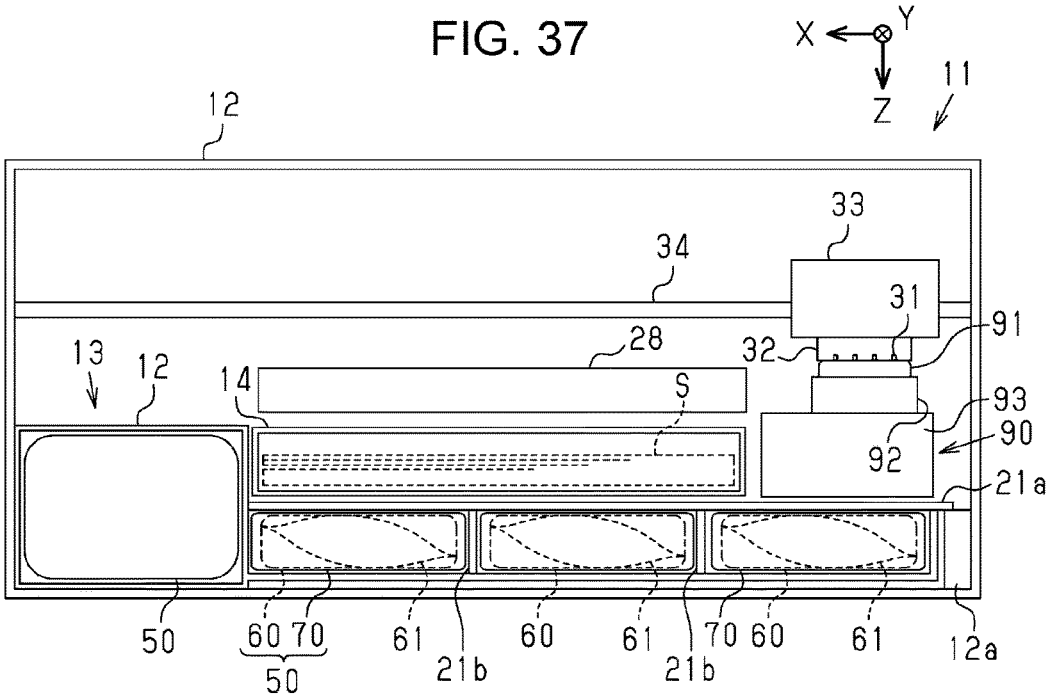
FIG. 37 is a front view of an internal structure of a first alternative embodiment of the liquid ejecting apparatus.
Figure 38:
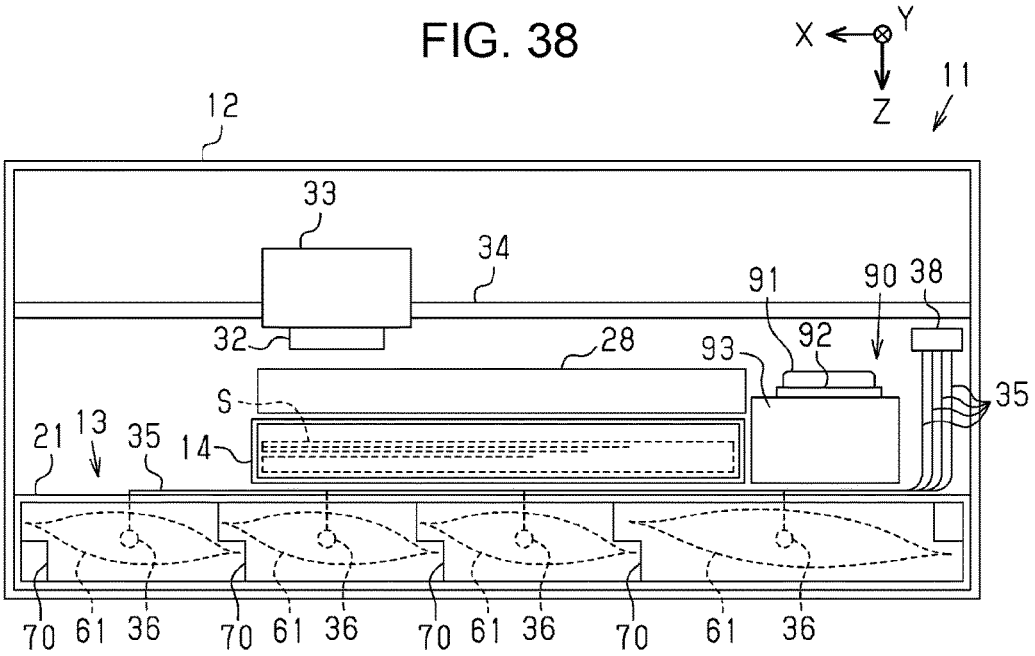
FIG. 38 is a front view of an internal structure of a second alternative embodiment of the liquid ejecting apparatus.

As the liquid ejecting apparatus 11 of a first alternative embodiment illustrated in FIG. 37 and a second alternative embodiment illustrated in FIG. 38, the liquid ejecting apparatus 11 may include a maintenance device 90 for the maintenance of the liquid ejecting head 32. The maintenance device 90 includes, for example, a cap 91 disposed at an end on the home side of the movement path in the width direction of the liquid ejecting head 32, a moving mechanism 92 which moves the cap 91 up and down, and a suction mechanism 93 which sucks and discharges the liquid in the liquid ejecting head 32 via the cap 91.

The liquid ejecting head 32 discharges the liquid toward the cap 91 to prevent or solve defective ejection by suction of the liquid upon driving of the suction mechanism 93, pressurized supply of the liquid upon driving of the supply mechanism 41, ejection of the liquid, or the like. When the liquid is not ejected, the liquid ejecting head 32 moves to a position at which the cap 91 is located and stops (this position is referred to as a home position), the moving mechanism 92 moves the cap 91 up to cover the nozzles 31 with the cap 91 (capping). Since drying of the nozzles 31 is prevented by capping, defective ejection caused by clogging of the nozzles 31 does not easily occur.

As the first alternative embodiment illustrated in FIG. 37, if a plurality of attachments 50 or containers 70 are arranged in the width direction in the attaching portion 13, the height of the attachments 50 or the containers 70 may differ from each other. In this case, if a liquid supplier 60 held by a container 70 which is longer in height may contain a greater amount of liquid, an increase in width can be prevented. If a container 70 which is longer in height may be disposed closer to an end in the width direction, flexure of the frame 21 can be prevented. If the medium container 14 is disposed at the center in width direction, since the container 70 which is longer in height can be disposed in a space formed on the side of the medium container 14, the space inside the exterior body 12 can be used effectively. The support portion 12*a* and the support projection 21*a* may be provided in either of the sides in the width direction (on the home side in FIG. 37).

As the second alternative embodiment illustrated in FIG. 38, if an attachment 50 (or a container 70) which is longer in width is disposed closer to an end in the width direction than an attachment 50 which is shorter in width, the end may be on the home side or on the opposite-home side. If a plurality of supply flow channels 35 are connected to the joint portion 38 located on the home side, the length of the supply flow channel 35 from each connecting portion 36 to the joint portion 38 becomes shorter as the distance from the supply flow channel 35 to an end portion on the home side becomes shorter. If the supply flow channel 35 is short, pressure loss caused by a flow of the liquid becomes smaller and, the liquid can be supplied efficiently. A liquid of high consumption per unit time is usually contained in a liquid supplier 60 which is long in width and has high liquid capacity. Therefore, if the liquid supplier 60 which is long in width is attached at the end on the home side, even if a liquid supply amount per unit time is large, the liquid can be supplied efficiently with the supply flow channels 35 of small pressure loss.

As the first alternative embodiment illustrated in FIG. 37 and the second alternative embodiment illustrated in FIG. 38, the liquid supplier 60 may be stored in the container 70 in an inclined orientation with respect to a horizontal plane so that both ends in the width direction of the liquid container 61 are positioned on the diagonal line of the container 70. In this manner, the storing space of the container 70 may be used efficiently and a liquid supplier 60 of higher liquid capacity can be attached.

In this case, as the second alternative embodiment illustrated in FIG. 38, ends in the width direction of the containers 70 adjacent to each other in the width direction may overlap in the vertical direction. In this manner, the accommodation space of the container 70 in the frame 21 may be used efficiently and a liquid supplier 60 of higher liquid capacity can be attached.

Figure 39:
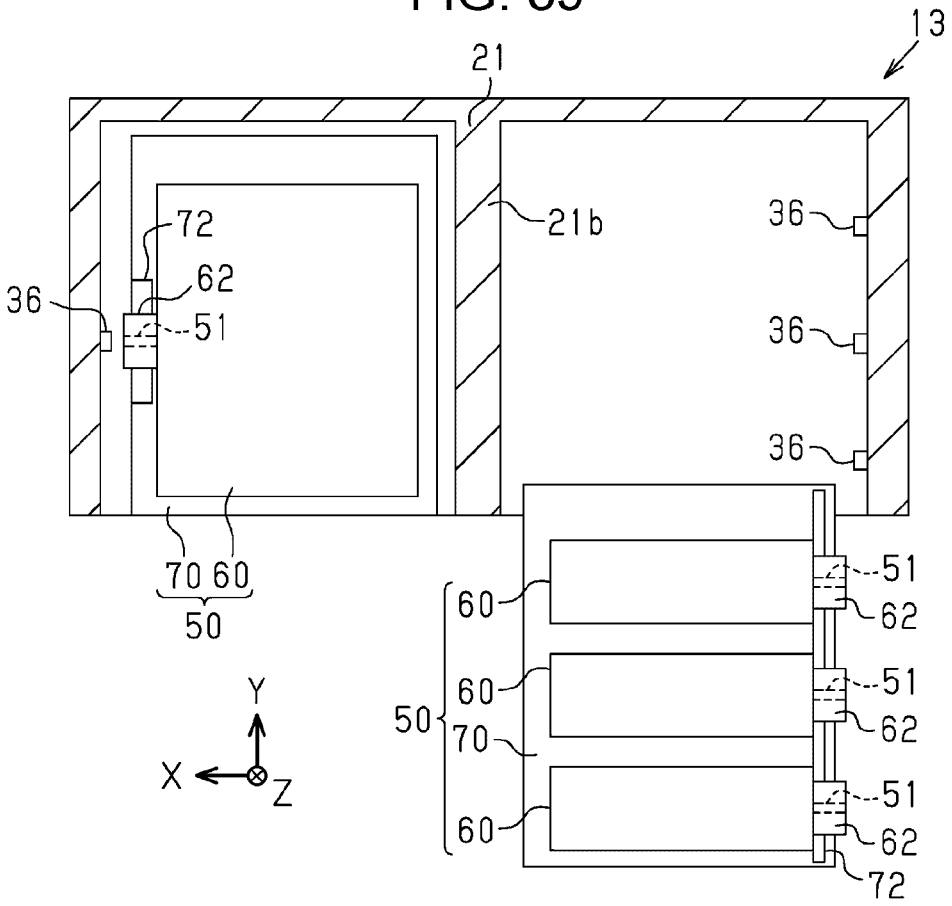
FIG. 39 is a cross-sectional view of a first alternative embodiment of the attaching portion provided in the liquid ejecting apparatus.

As an attaching portion 13 of a first alternative embodiment illustrated in FIG. 39, two accommodation spaces divided by the partition wall 21*b* may be formed in the frame 21. As the attaching portion 13 of the first alternative embodiment illustrated in FIG. 39, the inserting direction of the container 70 with respect to the accommodation space and the attaching direction of the container 70 with respect to the attaching portion 13 may be different from each other. For example, after the container 70 is inserted toward the rear side of the accommodation space, at least one of the container 70, the liquid supplier 60, and the connecting portion 36 is moved to the width direction, and the connecting portion 36 and the supply port 51 are connected with each other. In this case, the attaching direction coincides with the width direction.

As the container 70 to be attached on the right side in the attaching portion 13 of the first alternative embodiment illustrated in FIG. 39, a single engaging-portion-receiving portion 72 may include a configuration with which engaging portions 62 of a plurality of liquid suppliers 60 are engageable. A plurality of liquid suppliers 60 may engage with a single container 70, and then the container 70 may be attached to the attaching portion 13. For example, a plurality of (three, for example) small-sized liquid suppliers 60 corresponding to a plurality of colors of ink may desirably engage with a single container 70, and a middle-sized or large-sized liquid supplier 60 corresponding to black ink may desirably engage with another container 70. With this configuration, a plurality of liquid suppliers 60 can be inserted into the attaching portion 13 with a smaller number of containers 70 than the liquid suppliers 60 and, therefore, the number of parts can be reduced.

Figure 40:
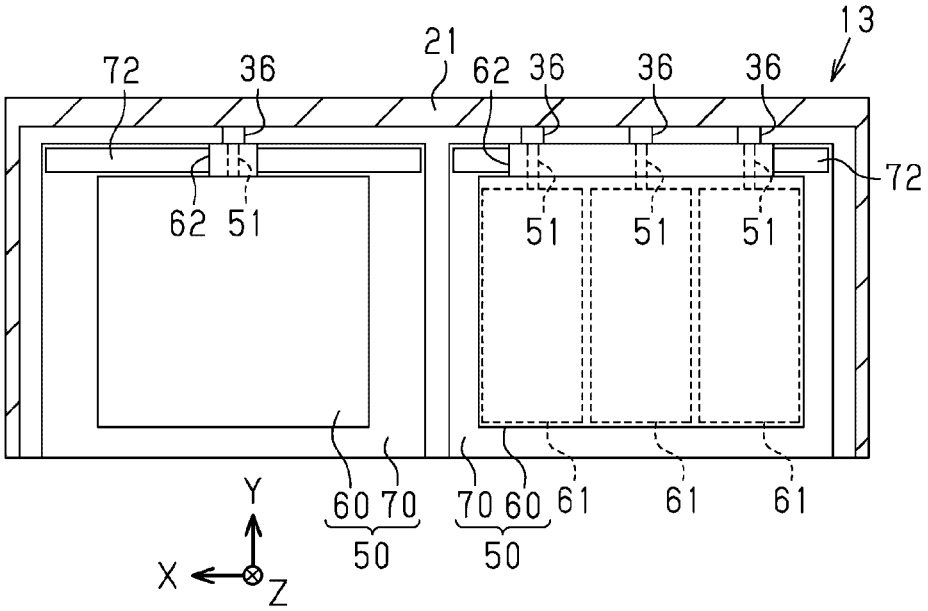
FIG. 40 is a cross-sectional view of a second alternative embodiment of the attaching portion provided in the liquid ejecting apparatus.

As an attaching portion 13 of the second alternative embodiment illustrated in FIG. 40, a plurality of mutually divided liquid containers 61 and a plurality of supply ports 51 each communicating with each liquid container 61 may be provided in a single liquid supplier 60 which is placed in a single container 70. In this case, a plurality of supply ports 51 may be integrated with a single engaging portion 62.

The side area SD may be provided in either of the home side or the opposite-home side of the transportation path. Only a single large-sized container 70L may be attached to the attaching portion 13. Alternatively, an attaching portion 13 to which a single large-sized container 70L is to be attached, and attaching portions 13 to which a plurality of small-sized or middle-sized containers 70 are to be attached may be arranged in the vertical direction.

The size of the liquid supplier 60 and the container 70 is not limited to those three (small, medium, and large) and may be changed into arbitrary sizes. The insertion ports 22 to the attaching portion 13 do not necessarily have to be disposed on the front surface of the exterior body 12. For example, the insertion ports 22 may be provided on the side surface extending in the depth direction of the exterior body 12. That is, the attaching direction of the attachments 50 is not limited to the depth direction of the exterior body 12, but the width direction of the exterior body 12 may be the attaching direction of the attachments 50 and the containers 70. In this case, the depth direction of the exterior body 12 and the depth direction (the attaching direction) of the attaching portion 13 are different from each other.

The liquid supplier 60 may be an adapter which does not include a liquid container 61 for containing a liquid, but includes a liquid supply flow channel communicating with the supply port 51. In this case, by connecting the liquid supply flow channel with a liquid container (for example, a reservoir containing a liquid) disposed outside of the exterior body 12, the liquid can be supplied to the liquid ejecting head 32 via the liquid supply flow channel from the liquid container outside of the exterior body 12. With this configuration, the size of the liquid container is not limited by the capacity of the exterior body 12 and, therefore, the liquid container can be increased in size and a greater amount of liquid can be ejected continuously.

The liquid supplier 60 as the liquid container provided with the liquid container 61 may engage with the container 70, and the liquid supplier 60 as an adapter provided with the liquid supply flow channel may engage with the container 70. If the liquid supplier 60 as an adapter engages with the container 70, a hole may desirably be formed on the front plate 78 through which the liquid supply flow channel passes.

If the liquid supplier 60 is an adapter which is not provided with the liquid container 61, the container 70 or the liquid supplier 60 is shorter in depth than width among the lengths in height, depth, and width in the attachment orientation. The attaching portion 13 may include both the liquid supplier 60 as an adapter which is not provided with the liquid container, and the liquid supplier 60 as the liquid container provided with the liquid container 61.

The liquid container 61 is not limited to a flexible bag but may be, for example, a rigid box (reservoir). In this case, an injection hole through which a liquid can be injected into the box may be provided. The liquid container 61 may be replenished with the liquid through the injection hole, or a tube may be connected to the injection hole to replenish the liquid container 61 with the liquid.

The order of arrangement of the attaching portion 13, the medium container 14, and the recording unit 16 in the vertical direction can be changed arbitrarily. For example, the attaching portion 13 may be disposed above the recording unit 16 in the vertical direction, or the attaching portion 13 may be disposed above the medium container 14 in the vertical direction. In addition to these mechanisms, a medium container 14 of different size, an image reading device, and the like may be disposed in the vertical direction.

The liquid ejected by the liquid ejecting portion is not limited to ink but may be, for example, a liquid material in which particles of a functional material are dispersed or mixed into a liquid. Recording may be performed by ejecting a liquid material which includes a material, such as an electrode material, a colorant (a pixel material) in the form of dispersion or dissolution used for manufacturing, for example, liquid crystal displays, electroluminescence (EL) displays, and surface-emitting displays.

The medium S is not limited to a paper sheet, but may be a plastic film, a thin plate material, or fabric used in a fabric printing apparatus, for example. The medium S is not limited to a sheet cut into a predetermined size, but may be, a roll-shaped medium rolled into a cylindrical shape, clothing of any shape, such as a T-shirt, and a three-dimensional object of any shape, such as tableware and stationery, for example.

The entire disclosure of Japanese Patent Application No. 2016-106433, filed May 27, 2016 is expressly incorporated by reference herein.

What is claimed is:

1. A liquid ejecting apparatus, comprising:

a liquid ejecting head that ejects a liquid supplied from a liquid supplier having a plurality of engaging portions and a supply port;

a container that has a plurality of engaging-portion-receiving portions with which the plurality of engaging portions respectively engage; and an attaching portion to which the container is detachably attached, wherein the container is detachably attached to the attaching portion in a state where the engaging portion of the liquid supplier has engaged with the engaging-portion-receiving portion, and receives an urging force from the attaching portion toward a starting end of a movement path of the container when the container is attached to the attaching portion, the container including a plurality of urging receiving portions for receiving the urging force, the plurality of urging receiving portions are provided at positions sandwiching the supply port in a horizontal direction that crosses a movement direction for attaching the container to the attaching portion.

2. The liquid ejecting apparatus according to claim 1, wherein the attaching portion includes a latching portion disposed in the movement path, and movement of the liquid supplier in a direction in which the liquid supplier is to be removed from the attaching portion is limited by the latching portion latching the container.

3. The liquid ejecting apparatus according to claim 1, wherein movement of the liquid supplier toward a starting end of the movement path is limited by the engaging portion engaging with the engaging-portion-receiving portion.

4. The liquid ejecting apparatus according to claim 1, wherein the container includes a pair of guide portions arranged in the direction which crosses the movement path in an attachment orientation for attachment to the attaching portion, and when the engaging portion engages with the engaging-portion-receiving portion, the guide portion guides the movement of the engaging portion.

5. The liquid ejecting apparatus according to claim 1, wherein the engaging-portion-receiving portion on a first side of the container has a shape that differs from the shape of the engaging-portion-receiving portion on a second side of the container in a direction which crosses the movement path.

6. The liquid ejecting apparatus according to claim 1, wherein the attaching portion includes an urging portion that urges the container toward the starting end of the movement path, and the container includes an urging receiving portion that receives the urging force of the urging portion at a leading end of the container upon attachment to the attaching portion.

7. The liquid ejecting apparatus according to claim 1, wherein the liquid supplier includes a supply port used as an outlet port for the liquid, the attaching portion includes a positioning projection projecting in the movement path and a connecting portion with which the supply port is connected when the liquid supplier is attached, and the positioning projection engages with the liquid supplier which moves toward the connecting portion with movement of the container and limits movement of the liquid supplier in a direction which crosses the movement path.

8. The liquid ejecting apparatus according to claim 1, wherein:

the attaching portion includes a guide provided along the movement path of the container, and the container includes a guided portion that is guided by the guide when the container is inserted in the attaching portion.

9. The liquid ejecting apparatus according to claim 1, wherein the container has an opening for attaching and detaching the liquid supplier and includes a movable cover capable of covering at least a part of the opening.

10. The liquid ejecting apparatus according to claim 1, wherein the attaching portion includes a first regulating portion that regulates a movement in a direction crossing a movement path of the container and a second regulating portion that further regulates the movement in the direction crossing the movement path of the container.

11. The liquid ejecting apparatus according to claim 10, wherein:

the first regulating portion includes a guide that guides the container, and the second regulating portion includes a positioning projection that projects in the movement path.

12. The liquid ejecting apparatus according to claim 1, further comprising:

a medium container, wherein the medium container is positioned between the liquid ejecting head and the attaching portion in a vertical direction.

13. The liquid ejecting apparatus according to claim 1, wherein the attaching portion includes a latching portion disposed in the movement path, the container includes a guide portion for guiding a movement of the liquid supplier and a latched portion latched by the latching portion, and the latched portion is provided on a starting end side of the movement path than the guide portion.

14. The liquid ejecting apparatus according to claim 1, wherein the plurality of engaging-portion-receiving portions comprises a first engaging-portion-receiving portion and a second engaging-portion-receiving portion, the plurality of urging receiving portions are provided at positions between the first engaging-portion-receiving portion and the second engaging-portion-receiving portion in the horizontal direction.

15. The liquid ejecting apparatus according to claim 1, further comprising:

a latching portion disposed in the movement path, and selectively engageable with a looped engagement path formed in an underside of the container.

* * * * *